US012509870B2

(12) United States Patent
Chen et al.

(10) Patent No.: US 12,509,870 B2
(45) Date of Patent: Dec. 30, 2025

(54) FLUSH TOILET

(71) Applicant: TOTO LTD., Kitakyushu (JP)

(72) Inventors: Jing Chen, Fukuoka (JP); Hiroshi Hashimoto, Fukuoka (JP); Satoshi Yamazaki, Fukuoka (JP); Kenichi Takano, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 177 days.

(21) Appl. No.: 18/231,881

(22) Filed: Aug. 9, 2023

(65) Prior Publication Data

US 2024/0060283 A1 Feb. 22, 2024

(30) Foreign Application Priority Data

Aug. 22, 2022 (JP) ..... 2022-131456
Aug. 22, 2022 (JP) ..... 2022-131490

(51) Int. Cl.
*E03D 11/08* (2006.01)
*E03D 11/13* (2006.01)

(52) U.S. Cl.
CPC ..... *E03D 11/08* (2013.01); *E03D 11/13* (2013.01); *E03D 2201/40* (2013.01)

(58) Field of Classification Search
CPC ..... E03D 11/08
See application file for complete search history.

(56) References Cited

U.S. PATENT DOCUMENTS

| | | | | |
|---|---|---|---|---|
| 2016/0222641 | A1* | 8/2016 | Urata | E03D 11/08 |
| 2018/0087256 | A1* | 3/2018 | Kashirajima | E03D 11/06 |
| 2021/0140163 | A1* | 5/2021 | Zhou | E03D 11/02 |
| 2021/0270028 | A1* | 9/2021 | Chen | E03D 11/08 |

FOREIGN PATENT DOCUMENTS

| | | |
|---|---|---|
| CN | 110924497 | 3/2020 |
| DE | 202021106357 | 12/2021 |
| EP | 2993274 | 3/2016 |
| EP | 3269886 | 1/2018 |
| GB | 685960 | 1/1953 |
| JP | 2015-183484 | 10/2015 |
| JP | 2015-196959 | 11/2015 |
| JP | 2016-142100 | 8/2016 |
| JP | 2018-159246 | 10/2018 |
| JP | 2021-008790 | 1/2021 |
| JP | 2021-025225 | 2/2021 |
| JP | 2021-134642 | 9/2021 |
| WO | 2016/143029 | 9/2016 |

* cited by examiner

*Primary Examiner* — Lauren A Crane

(74) *Attorney, Agent, or Firm* — Amin, Turocy & Watson, LLP

(57) ABSTRACT

A flush toilet includes a bowl part that includes a waste-receiving surface with a bowl shape that receives waste and a rim part that extends upward on an upper edge part of the waste-receiving surface, a first water-spouting port that spouts a washing water toward the rim part to form a first flow of a washing water that swirls on the waste-receiving surface, a second water-spouting port that spouts a washing water toward the rim part to form a second flow of a washing water that joins the first flow, and a connection part that includes a concave surface that connects the waste-receiving surface and the rim part and is curved to have a curvature that decreases from an upstream side to a downstream side of the first flow just before the first water-spouting port or the second water-spouting port in a flow direction of the first flow.

9 Claims, 12 Drawing Sheets

FLUSH TOILET

CROSS-REFERENCE TO RELATED APPLICATION(S)

This application is based upon and claims the benefit of priority to Japanese Patent Application No. 2022-131456 filed on Aug. 22, 2022, the entire contents of which are herein incorporated by reference, and Japanese Patent Application No. 2022-131490 filed on Aug. 22, 2022, the entire contents of which are herein incorporated by reference.

FIELD

A disclosed embodiment(s) relate(s) to a flush toilet.

BACKGROUND

A flush toilet has conventionally been known that includes a bowl part that has a waste-receiving surface with a bowl shape that receives waste and a rim part that extends upward on an upper edge part of the waste-receiving surface, wherein a plurality of water-spouting ports that spout a washing water are included. Such a plurality of water-spouting ports have, for example, a first water-spouting port that spouts a washing water so as to form a first swirling flow that swirls on a waste-receiving surface and a second water-spouting port that spouts a washing water so as to form a second swirling flow that joins the first swirling flow (see, for example, Japanese Patent Application Publication No. 2021-008790).

However, in a conventional flush toilet as described above, for example, in a case where water force of a washing water that is spouted from a first water-spouting port is strong, such as a so-called flush valve toilet that supplies a primary water pressure to a toilet body, a washing water that swirls on a waste-receiving surface by centrifugal force maintains swirling force even in a back part area of the waste-receiving surface, so that a washing water may be prevented from readily flowing downward in the back part area of the waste-receiving surface. Hence, in a back part area of a waste-receiving surface where a washing water does not readily flow downward, leaving a part unwashed may be caused.

A flush toilet has conventionally been known that includes a bowl part that has a waste-receiving surface with a bowl shape that receives waste and a rim part that extends upward on an upper edge part of the waste-receiving surface, wherein a first water-spouting port that spouts a washing water so as to form a first swirling flow that swirls on the waste-receiving surface, a first rim water conduit where a washing water that is supplied to the first water-spouting port flows, a second water-spouting port that spouts a washing water so as to form a second swirling flow that joins the first swirling flow, and a second rim water conduit where a washing water that is supplied to the second water-spouting port flows are included (see, for example, Japanese Patent Application Publication No. 2016-142100).

However, in a conventional flush toilet as described above, for example, in a case where water force of a washing water that is spouted from a first water-spouting port is strong, such as a so-called flush valve toilet that supplies a primary water pressure to a toilet body, a washing water from a second water-spouting port is also spouted with strong water force, so that a washing water may be prevented from readily flowing downward in an area of the waste-receiving surface under the second water-spouting port. Hence, in an area of a waste-receiving surface under a second water-spouting port where a washing water does not readily flow downward, leaving a part unwashed may be caused.

Thus, in a conventional flush toilet as described above, there is room for improvement of a washing performance for a waste-receiving surface.

SUMMARY

A flush toilet according to an aspect of an embodiment includes a bowl part that has a waste-receiving surface with a bowl shape that receives waste and a rim part that extends upward on an upper edge part of the waste-receiving surface, a trap pipe line that is communicated with a bottom part of the bowl part and extends from the bottom part, and discharges waste that is received by the waste-receiving surface, a first water-spouting port that spouts a washing water toward the rim part so as to form a first flow of a washing water that swirls on the waste-receiving surface, a second water-spouting port that spouts a washing water toward the rim part so as to form a second flow of a washing water that joins the first flow, and a connection part that has a concave surface that connects the waste-receiving surface and the rim part and is curved so as to have a curvature that decreases from an upstream side to a downstream side of the first flow just before the first water-spouting port or the second water-spouting port in a flow direction of the first flow.

BRIEF DESCRIPTION OF DRAWING(S)

DESCRIPTION OF EMBODIMENT(S)

Hereinafter, an embodiment(s) of a flush toilet as disclosed in the present application will be explained in detail with reference to the accompanying drawing(s). Additionally, this invention is not limited by an embodiment(s) as illustrated below.

1. First Embodiment

1-1. General Configuration of Flush Toilet

Figure 1:
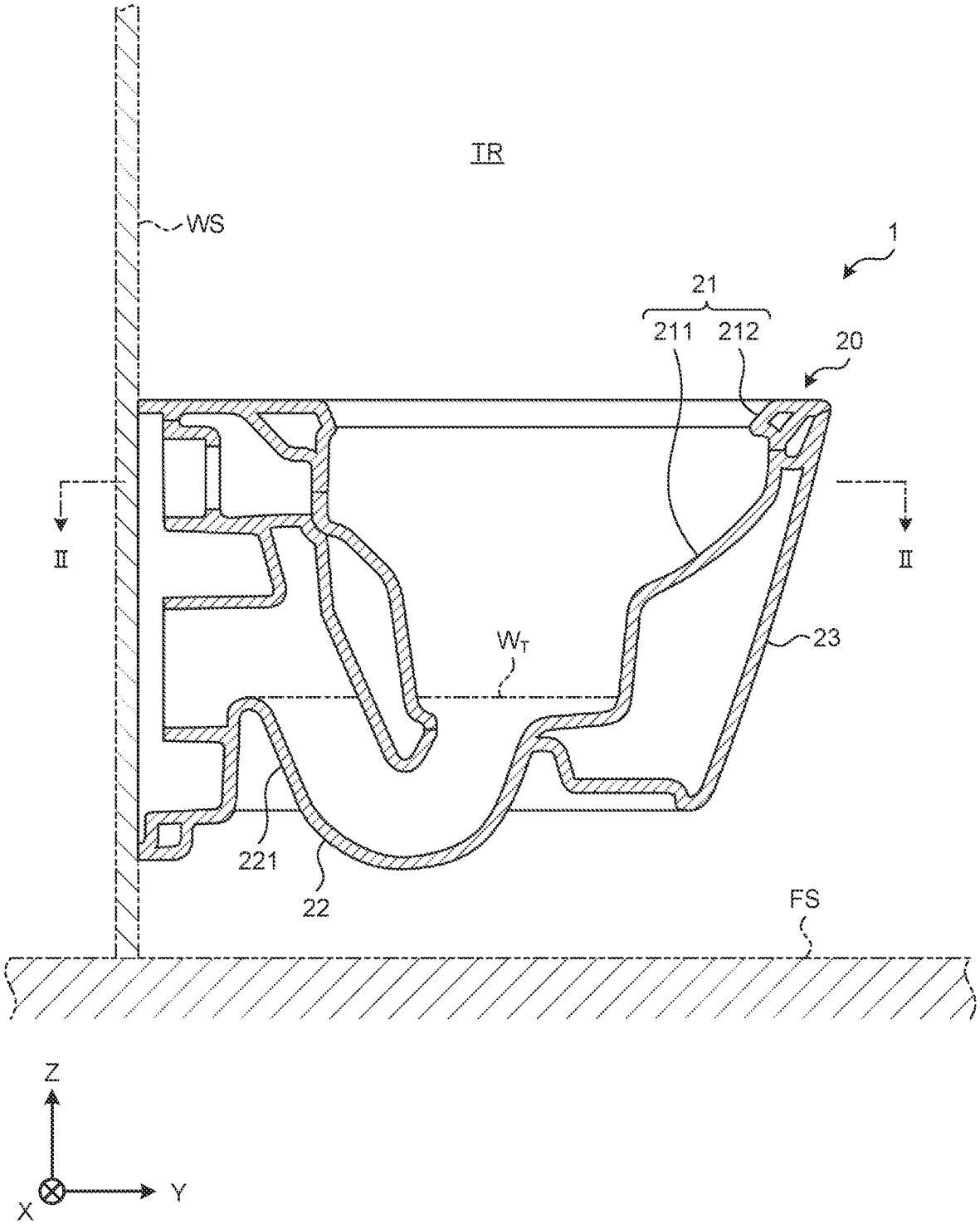
FIG. 1 is a schematic cross-sectional side view that illustrates a flush toilet according to a first embodiment.
Figure 2A:
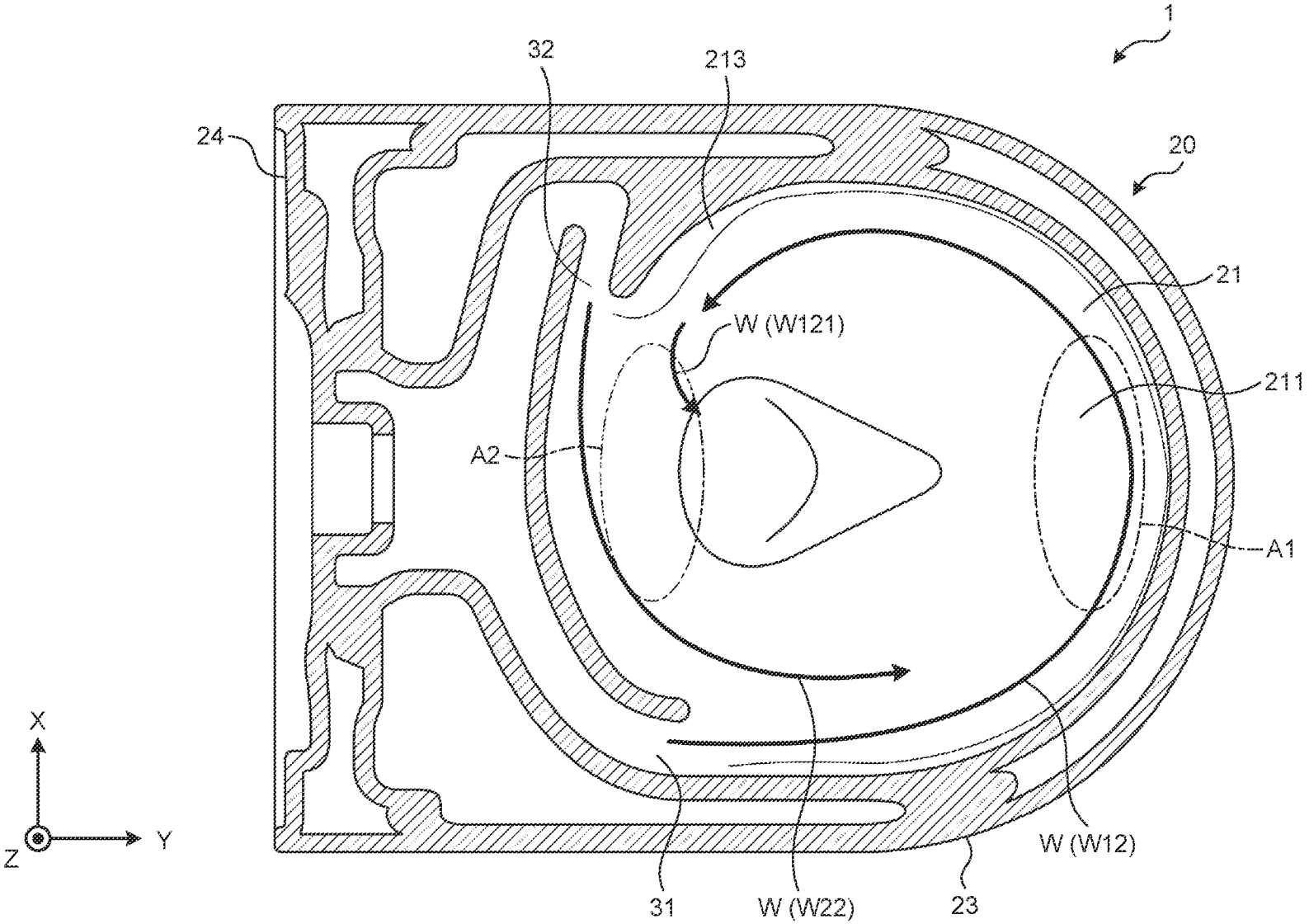
FIG. 2A is a cross-sectional view (part 1) along line II-II in FIG. 1.
Figure 2B:
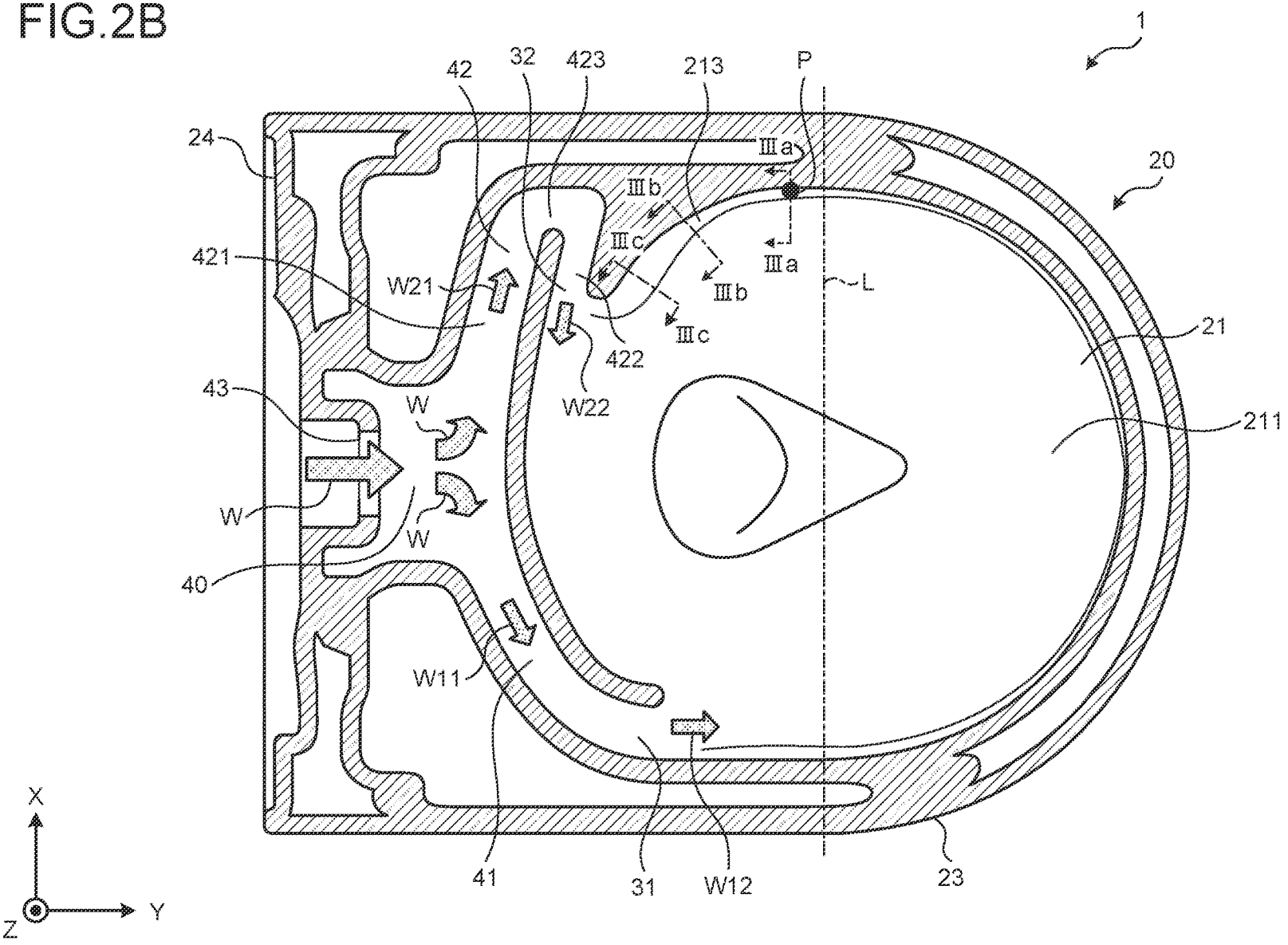
FIG. 2B is a cross-sectional view (part 2) along line II-II in FIG. 1.

A general configuration of a flush toilet 1 according to a first embodiment will be explained with reference to FIGS. 1, 2A, and 2B. FIG. 1 is a schematic cross-sectional side view that illustrates a flush toilet according to a first embodiment. FIGS. 2A and 2B are cross-sectional views along line II-II in FIG. 1. Additionally, FIG. 2A illustrates flows (swirling flows) of washing waters W12, W22 at a time of toilet washing. Furthermore, FIG. 2B illustrates flows of washing waters W11, W21 that are supplied to a first water-spouting port 31 and a second water-spouting port 32.

Furthermore, each figure illustrates a three-dimensional orthogonal coordinate system that includes a Z-axis where a vertically upward direction (an upper side) thereof is provided as a positive direction. Hereinafter, a positive direction of an X-axis, a negative direction of an X-axis, a positive direction of a Y-axis, and a negative direction of a Y-axis are defined as a left side, a right side, a front side, and a back side, respectively, and further, directions of an X-axis, directions of a Y-axis, and directions of a Z-axis are referred to as leftward and rightward directions, frontward and backward directions, and upward and downward directions, respectively, for explanatory convenience.

As illustrated in FIG. 1, a flush toilet 1 is a so-called wall-mounted type that is installed on a wall surface WS of a toilet room TR. Additionally, the flush toilet 1 may be a so-called floor-mounted type that is installed on a floor surface FS of a toilet room TR.

Furthermore, the flush toilet 1 is a so-called flush valve toilet where a washing water is supplied to a toilet body 20 as described later by a primary water pressure from a water supply source such as a water tap. Additionally, the flush toilet 1 may supply a washing water from, for example, a water storage tank that is provided as a water supply source that is attached to a back side of a wall surface WS, to the toilet body 20. Furthermore, a (non-illustrated) drain pipe for discharging waste is provided on a back side of a wall surface WS. A drain pipe is connected to a trap pipe line 22 of the toilet body 20 as described later through, for example, a (non-illustrated) drain socket, etc.

Furthermore, the flush toilet 1 (the toilet body 20) is made of a ceramic. Additionally, the flush toilet 1 is not limited to one that is made of a ceramic and may be made of a resin or may be manufactured by combining a ceramic and a resin.

Furthermore, a toilet seat (or a toilet seat device that has a function of washing a private part), a toilet seat cover, etc., that are not illustrated in the figure(s) are attached to the flush toilet 1 on an upper side of the toilet body 20.

As illustrated in FIGS. 1, 2A, and 2B, the flush toilet 1 includes a toilet body 20. The toilet body 20 includes a bowl part 21, a trap pipe line 22, a skirt part 23, and a back surface 24. Furthermore, the flush toilet 1 includes a plurality of water-spouting ports (a first water-spouting port 31 and a second water-spouting port 32). Furthermore, the flush toilet 1 includes a main water conduit 40, a first rim water conduit 41, and a second rim water conduit 42.

The bowl part 21 includes a waste-receiving surface 211, a rim part 212, and a connection part 213. The waste-receiving surface 211 is a site that receives waste and is formed into a bowl shape (a concave shape). The rim part 212 is provided so as to extend upward on an upper edge part of the waste-receiving surface 211. The rim part 212 is formed into a ring shape along an upper edge part of the waste-receiving surface 211.

The connection part 213 connects the waste-receiving surface 211 and the rim part 212. The connection part 213 has a concave surface 213*a* as described later on an upper surface (a front surface) thereof so as to connect the waste-receiving surface 211 and the rim part 212 smoothly. A detail of the connection part 213 will be described later, by using FIG. 3, etc.

A predetermined amount of a pooled water $W_T$ is stored or pooled in a bottom part of the bowl part 21 (the waste-receiving surface 211). Furthermore, the trap pipe line 22 is connected to a bottom part of the bowl part 21.

The trap pipe line 22 is communicated with a bottom part of the bowl part 21. Furthermore, the trap pipe line 22 is a pipe line that extends backward from a bottom part of the bowl part 21. The trap pipe line 22 discharges waste that is received by the waste-receiving surface 211 of the bowl part 21 to a drain pipe that is an external pipe. Furthermore, the trap pipe line 22 defines a water level of a pooled water $W_T$ that is formed on a bottom part of the bowl part 21, by a top part of an ascending part 221 that is sloped so as to ascend toward a back side thereof.

The skirt part 23 is provided so as to cover a side part of the bowl part 21 on one of left and right sides thereof to a side surface thereof on another of the left and right sides through a front part thereof. The skirt part 23 composes an appearance of the flush toilet 1.

The back surface 24 is provided on a back side of the bowl part 21. The back surface 24 is fixed on a wall surface WS of a toilet room TR by, for example, attaching an (non-illustrated) attachment tool(s) to an (non-illustrated) attachment hole(s) thereof. Thus, the back surface 24 is fixed on a wall surface WS, so that the flush toilet 1 is fixed on the wall surface WS.

As illustrated in FIGS. 2A and 2B, the flush toilet 1 includes a plurality of water-spouting ports that spout a washing water W to the bowl part 21 in order to wash the bowl part 21 (the waste-receiving surface 211). The flush toilet 1 includes a first water-spouting port 31 and a second water-spouting port 32. The first water-spouting port 31 is arranged on a back part of the bowl part 21 and spouts a washing water W toward the rim part 212. The first water-spouting port 31 spouts a washing water W12 from a back side of the waste-receiving surface 211 on one of left and right sides (for example, a right side) thereof.

The first water-spouting port 31 forms a first flow (a first swirling flow) of a washing water W12 that swirls on the waste-receiving surface 211. That is, a washing water W that is spouted from the first water-spouting port 31 is provided as a first swirling flow (a washing water W12) that swirls on the waste-receiving surface 211 and the connection part 213 by centrifugal force.

The second water-spouting port 32 is arranged on back part of the bowl part 21 and spouts a washing water W toward the rim part 212. The second water-spouting port 32 spouts a washing water W22 from a back side of the waste-receiving surface 211 on another of left and right sides (for example, a left side) thereof.

The second water-spouting port 32 joins a first swirling flow (a washing water W12) and forms, together with the first swirling flow (the washing water W12), a second flow (a second swirling flow) of a washing water W22 that swirls on the waste-receiving surface 211. That is, a washing water W22 that is spouted from the second water-spouting port 32 is provided as a second swirling flow (a washing water W22)

that swirls on the waste-receiving surface 211 and the connection part 213, by centrifugal force, similarly to a first swirling flow (a washing water W12). Additionally, a first swirling flow (a washing water W12) and a second swirling flow (a washing water W22) may swirl where a part on the rim part 212 is included.

Thus, washing waters W (W12, W22) that are spouted from the first water-spouting port 31 and the second water-spouting port 32 swirl so as to be provided as a first swirling flow (a washing water W12) that flows into the trap pipe line 22 and a second swirling flow (a washing water W22), respectively. In the flush toilet 1, the waste-receiving surface 211 is washed (tornado-washed) with such a first swirling flow (a washing water W12) and a second swirling flow (a washing water W22).

As illustrated in FIG. 2B, the flush toilet 1 includes a main water conduit 40, a first rim water conduit 41, and a second rim water conduit 42. The main water conduit 40 extends frontward from a supply port 43 for a washing water W in the flush toilet 1. A washing water W for being supplied to the bowl part 21 flows through the main water conduit 40. A washing water W that flows through the main water conduit 40 is branched into leftward and rightward directions on a downstream side where one thereof is supplied to a first rim water conduit 41 as described later and another thereof is supplied to a second rim water conduit 42 as described later.

The first rim water conduit 41 is arranged on an upstream side of the first water-spouting port 31. A washing water W11 that is branched from the main water conduit 40 flows through the first rim water conduit 41. The first water-spouting port 31 is formed on a downstream end part of the first rim water conduit 41. That is, a washing water W11 that is supplied to the first water-spouting port 31 flows through the first rim water conduit 41.

The second rim water conduit 42 is arranged on an upstream side of the second water-spouting port 32. A washing water W21 that is branched from the main water conduit 40 flows through the second rim water conduit 42. The second water-spouting port 32 is formed on a downstream end part of the second rim water conduit 42. That is, a washing water W21 that is supplied to the second water-spouting port 32 flows through the second rim water conduit 42.

Furthermore, the second rim water conduit 42 includes an upstream side water conduit 421, a downstream side water conduit 422, and a bending part 423. The upstream side water conduit 421 extends toward a left side in such a manner that a washing water W21 that is branched from the main water conduit 40 flows to, for example, a left side. The downstream side water conduit 422 extends toward an opposite direction of a direction where the upstream side water conduit 421 extends (for example, toward a right side). The second water-spouting port 32 is formed on a downstream end part of the downstream side water conduit 422.

The bending part 423 is provided so as to connect the upstream side water conduit 421 and the downstream side water conduit 422 on a downstream end part of the upstream side water conduit 421 and an upstream end part of the downstream side water conduit 422. Such a bending part 423 changes a flow direction of a washing water W21 that is supplied to the second water-spouting port 32 to an opposite direction thereof, in the second rim water conduit 42.

Herein, in a case where water force of a washing water W that is spouted from the first water-spouting port 31 is strong, such as a flush valve toilet, a washing water W12 that swirls on the bowl part 21 by centrifugal force maintains swirling force even in a back part area A2 of the bowl part 21 (the waste-receiving surface 211), so that a washing water W may be prevented from readily flowing downward in the back part area A2 of the waste-receiving surface 211. Hence, leaving a part unwashed may occur in a back part area A2 of the waste-receiving surface 211 where a washing water W12 does not readily flow downward.

In a case where the concave surface 213*a* (see FIG. 3) of the connection part 213 that connects the waste-receiving surface 211 and the rim part 212 has a constant curvature from an upstream side to a downstream side in a flow direction of a washing water W12, it is considered that a washing water W12 does not readily flow downward in a back part area A2 of the waste-receiving surface 211. Hence, in the present embodiment, a curvature of the concave surface 213*a* of the connection part 213 is decreased from an upstream side to a downstream side in a flow direction of a washing water W12 so as to form a downward flow of the washing water W12 in a back part area A2 of the waste-receiving surface 211.

1-2. Concave Surface of Connection Part

Figure 3:
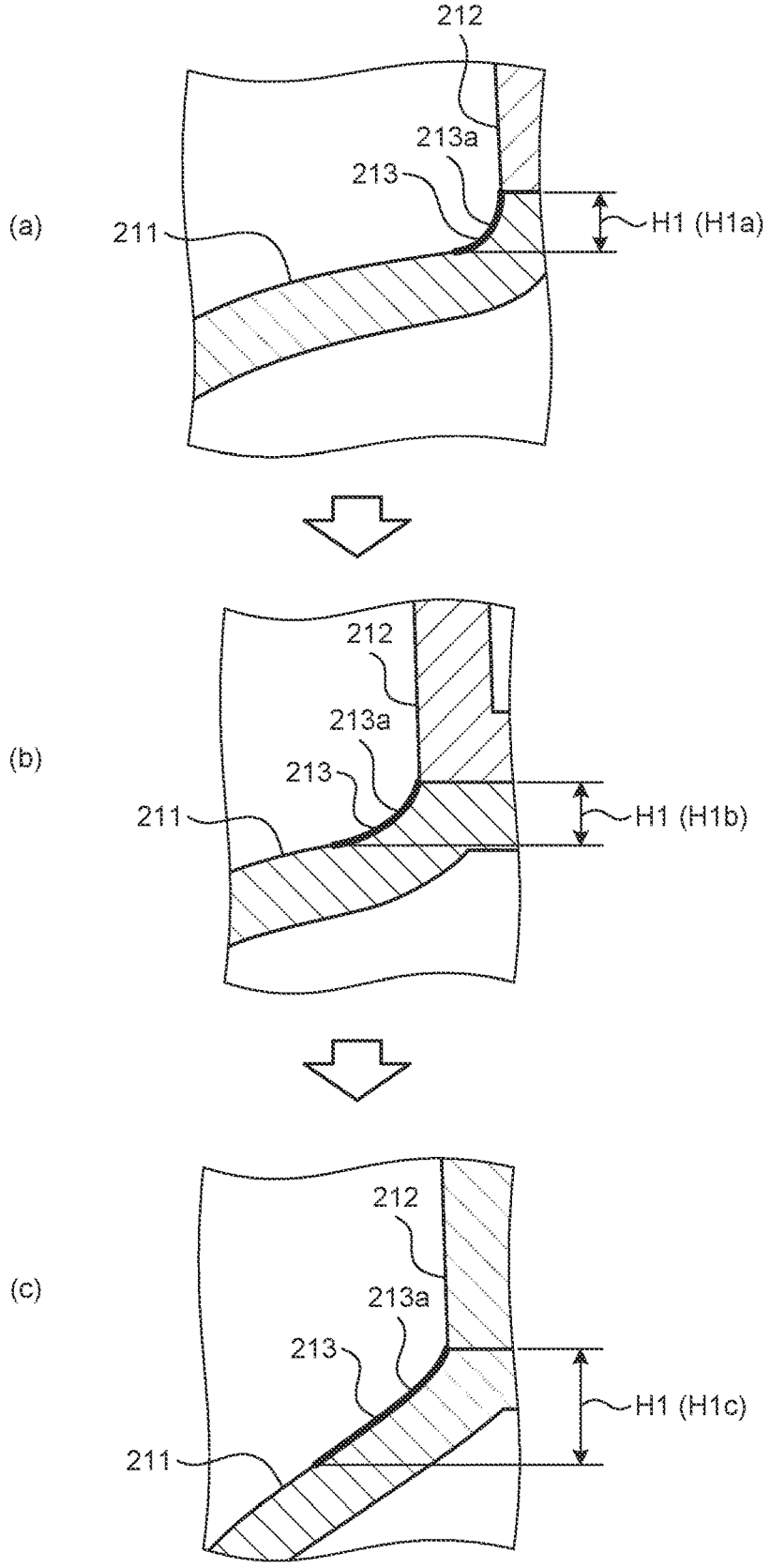
FIG. 3 is a schematic cross-sectional view along line IIIa-IIIa, a schematic cross-sectional view along line IIIb-IIIb, and a schematic cross-sectional view along line IIIc-IIIc, in FIG. 2B.

Next, a concave surface 213*a* of a connection part 213 will be explained with reference to FIG. 3. FIG. 3 is a schematic cross-sectional view along line IIIa-IIIa, a schematic cross-sectional view along line IIIb-IIIb, and a schematic cross-sectional view along line IIIc-IIIc, in FIG. 2B. Additionally, (a), (b), and (c) in FIG. 3 illustrate a schematic cross-section along line IIIa-IIIa, a schematic cross-section along line IIIb-IIIb, and a schematic cross-section along line IIIc-IIIc, respectively.

Furthermore, each of a cross-section along line IIIa-IIIa, a cross-section along line IIIb-IIIb, and a cross-section along line IIIc-IIIc in FIG. 3 is a cross-section that is orthogonal to a flow direction of a washing water W12. That is, (a), (b), and (c) in FIG. 3 illustrate a cross-section on an upstream side in a flow direction of a washing water W12, a cross-section on a downstream side of (a), and a cross-section on a downstream side of (b), respectively. Furthermore, FIG. 3 illustrates the connection part 213 (the concave surface 213*a*) as a thick line part.

As illustrated in FIG. 3, the connection part 213 that connects a waste-receiving surface 211 and a rim part 212 has the concave surface 213*a* that is curved downward so as to have a predetermined curvature on an upper surface (a front surface) thereof. Furthermore, the concave surface 213*a* of the connection part 213 is curved so as to have a curvature that decreases from an upstream side to a downstream side just before a second water-spouting port 32 (see FIGS. 2A and 2B) in a flow direction of a washing water W12 on a first swirling flow.

Furthermore, as illustrated in FIG. 3, the concave surface 213*a* of the connection part 213 is formed in such a manner that a length H1 thereof in upward and downward directions gradually increases from an upstream side to a downstream side in a flow direction of a washing water W12 on a first swirling flow. That is, a length H1 thereof in upward and downward directions has a relationship of "H1*a*<H1*b*<H1*c*". Furthermore, in other words, the concave surface 213*a* of the connection part 213 is provided in such a manner that an occupation of a bowl part 21 (see FIGS. 2A and 2B) in upward and downward directions increases from an upstream side to a downstream side in a flow direction of a washing water W12 on a first swirling flow.

Furthermore, by returning to FIG. 2B, the connection part 213 is formed in such a manner that a starting point P in a flow direction of a washing water W12 on a first swirling flow where a curvature of the concave surface 213*a* starts to decrease is positioned at a back side of a center (a center line L) of the bowl part 21 in frontward and backward directions.

1-3. Mode of First Flow (First Swirling Flow)

Figure 4:
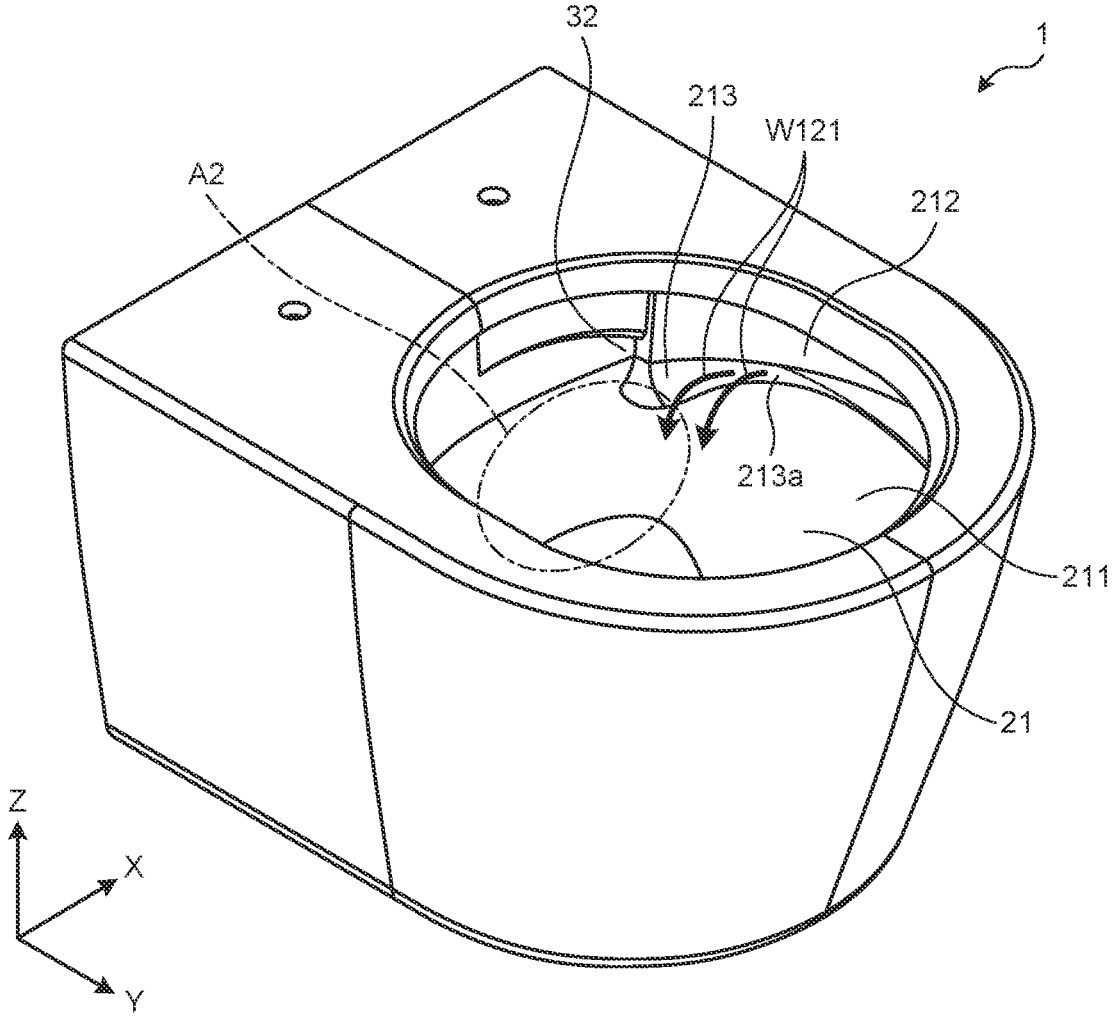
FIG. 4 is an explanatory diagram of a first flow (a first swirling flow) of a washing water in a flush toilet according to a first embodiment.

Next, a mode of a first flow (a first swirling flow) of a washing water W12 (W121) will be explained with reference to FIG. 4. FIG. 4 is an explanatory diagram of a first flow (a first swirling flow) of a washing water W12 (W121) in a flush toilet 1 according to a first embodiment.

As described above, a curvature of a concave surface 213*a* of a connection part 213 decreases from an upstream side to a downstream side just before a second water-spouting port 32 in a flow direction of a first swirling flow (a washing water W12) (see FIG. 2A), so that a vector with a downward direction for a washing water W12 that is spouted from a first water-spouting port 31 (see FIG. 2A) increases at the concave surface 213*a* of the connection part 213 that is positioned just before the second water-spouting port 32.

Hence, as illustrated in FIG. 4, a first swirling flow (a washing water W12) includes a downward flow (a washing water W121) just before the second water-spouting port 32. Then, such a washing water W121 is provided as a flow toward a back part area A2 of a waste-receiving surface 211 so as to wash the back part area A2 of the waste-receiving surface 211.

In the flush toilet 1 according to a first embodiment as described above, a curvature of the concave surface 213*a* of the connection part 213 decreases from an upstream side to a downstream side just before the second water-spouting port 32 in a flow direction of a first swirling flow (a washing water W12), so that it is possible to increase a vector with a downward direction for a washing water W12 (W121) that swirls on the waste-receiving surface 211 by centrifugal force and it is possible to spread a water flux of a washing water W121 that flows in a concentrated manner, in a fan-like form, toward a back part of the waste-receiving surface 211. Hence, even in the flush toilet 1 where a washing water W12 with strong water force is spouted from the first water-spouting port 31, such as a flush valve toilet, it is possible to cause a washing water W121 to flow downward from a top part to a bottom part of the waste-receiving surface 211 and wash a wide area of a back part of a bowl part 21 (a back part of the waste-receiving surface 211). Thereby, it is possible to reduce or prevent occurrence of leaving a part of the waste-receiving surface 211 unwashed, so that it is possible to improve a washing performance for the waste-receiving surface 211.

Furthermore, an occupancy of the connection part 213 in upward and downward directions increases from an upstream side to a downstream side in a flow direction of a first swirling flow (a washing water W12), so that it is possible to further increase a vector with a downward direction for a washing water W12 (W121) that swirls on the waste-receiving surface 211 by centrifugal force. Hence, even in the flush toilet 1 where a washing water W12 with strong water force is spouted from the first water-spouting port 31, such as a flush valve toilet, it is possible to cause a washing water to flow downward from a top part to a bottom part of the waste-receiving surface 211. Thereby, it is possible to reduce or prevent occurrence of leaving a part of the waste-receiving surface 211 unwashed, so that it is possible to improve a washing performance for the waste-receiving surface 211.

Furthermore, a curvature of the concave surface 213*a* of the connection part 213 decreases from an upstream side to a downstream side just before the second water-spouting port 32 in a flow direction of a first swirling flow (a washing water W12), and further, a starting point P where a curvature of the concave surface 213*a* of the connection part 213 deceases is positioned at a back side of a center (a center line L) of the bowl part 21 in frontward and backward directions, so that it is possible to further increase a vector with a downward direction for a washing water W12 (W121) that swirls on the waste-receiving surface 211 by centrifugal force.

Furthermore, a starting point P where a curvature of the concave surface 213*a* of the connection part 213 deceases is positioned at a back side of a center (a center line L) of the bowl part 21 in frontward and backward directions, so that it is possible to cause a washing water W121 to flow downward while a water flux of such a washing water W121 is prevented from excessively spreading downward. Thereby, it is possible to reduce or prevent occurring of an unwashed state of an upper end part of the waste-receiving surface 211.

Furthermore, it is possible to cause a washing water W12 (W121) to flow downward in a back part area A2 (see FIG. 2A) of the bowl part 21 (the waste-receiving surface 211) while preventing water force of a washing water W12 from dropping in a front part area A1 (see FIG. 2A) of the bowl part 21 (the waste-receiving surface 211). Hence, even in the flush toilet 1 where a washing water W12 with strong water force is spouted from the first water-spouting port 31, such as a flush valve toilet, it is possible to cause a washing water W12 (W121) to flow downward from a top part to a bottom part of the waste-receiving surface 211. Thereby, it is possible to reduce or prevent occurrence of leaving a part of the waste-receiving surface 211 unwashed, so that it is possible to improve a washing performance for the waste-receiving surface 211.

2. Second Embodiment

Figure 5:
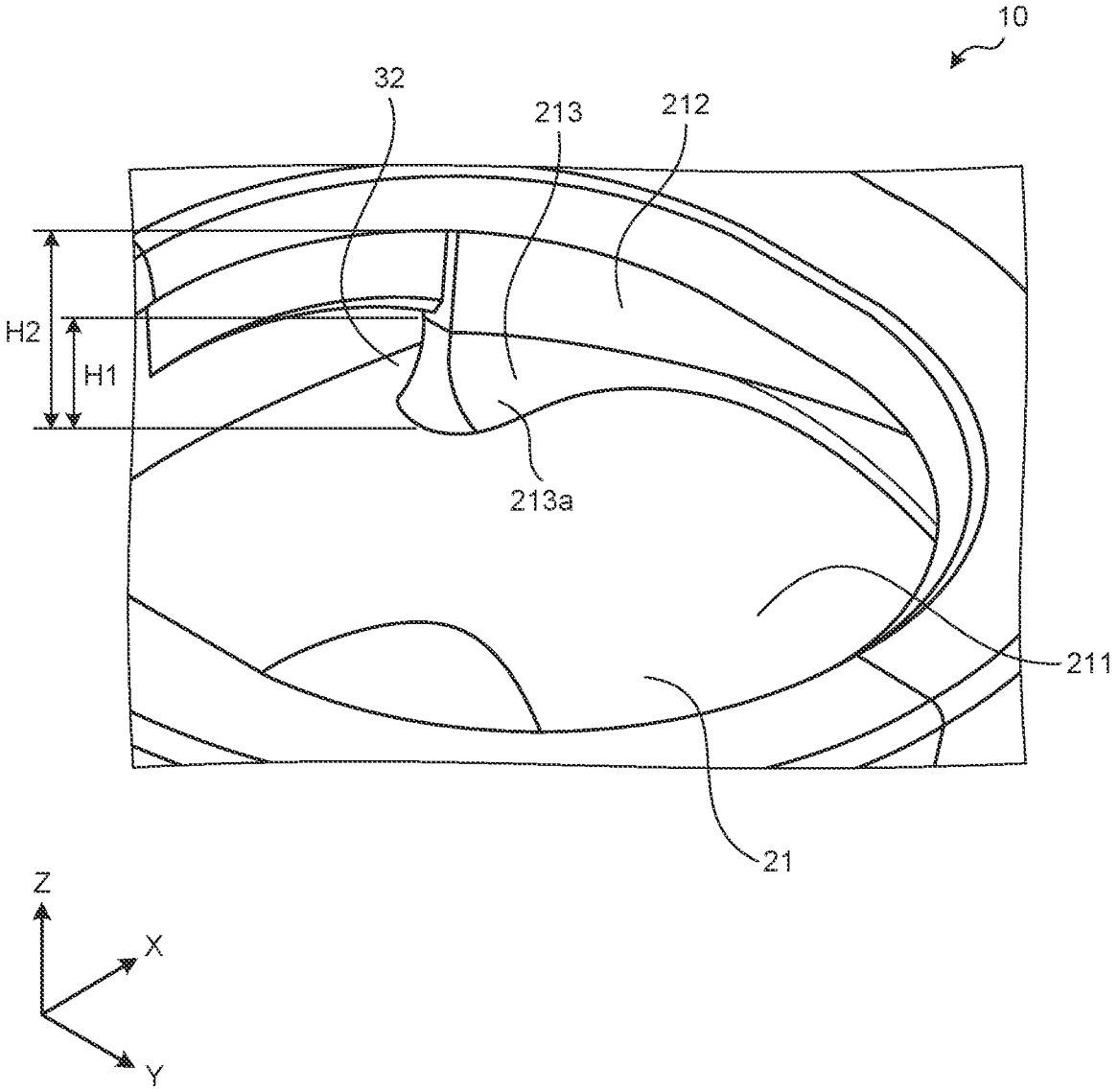
FIG. 5 is an explanatory diagram of a flush toilet according to a second embodiment.

Next, a flush toilet 10 according to a second embodiment will be explained with reference to FIG. 5. FIG. 5 is an explanatory diagram of a flush toilet 10 according to a second embodiment. Additionally, FIG. 5 illustrates a partially-enlarged perspective view of the flush toilet 10 according to a second embodiment.

Furthermore, the flush toilet 10 according to a second embodiment is different from a flush toilet 1 according to a first embodiment, with respect to a ratio of lengths of a rim part 212 and a connection part 213 in upward and downward directions. Hence, in an explanation as provided below, an explanation of a part that is equivalent or identical to that of a first embodiment will be omitted.

As illustrated in FIG. 5, in the flush toilet 10, a length H1 of the connection part 213 in upward and downward directions occupies half or more of a distance (a length H2 in upward and downward directions) from a lowermost end of the connection part 213 to an uppermost end of the rim part 212 on a downstream side of a starting point P (see FIG. 2B) in a flow direction of a washing water W12 on a first swirling flow where a curvature of a concave surface 213*a* decreases.

In such a flush toilet 10 according to a second embodiment, a length H1 of the connection part 213 occupies half or more of a distance (a length H2) from a lowermost end of the connection part 213 to an uppermost end of the rim part 212 on a downstream side of a starting point P where a curvature of the concave surface 213*a* decreases, so that it is possible to further increase a vector with a downward direction for a washing water W12 that swirls on a waste-receiving surface 211 by centrifugal force. Furthermore, it is possible to cause a washing water W12 (W121) to flow downward in a back part area A2 of a bowl part 21 (the waste-receiving surface 211) while preventing water force of a washing water W12 from dropping in a front part area A1 of the bowl part 21 (the waste-receiving surface 211). Hence, even in the flush toilet 10 where a washing water W12 with strong water force is spouted from a first water-spouting port 31, such as a flush valve toilet, it is possible to cause a washing water W121 to flow downward from a top part to a bottom part of the waste-receiving surface 211. Thereby, it is possible to reduce or prevent occurrence of leaving a part of the waste-receiving surface 211 unwashed, so that it is possible to improve a washing performance for the waste-receiving surface 211.

Additionally, although an embodiment as described above is configured in such a manner that a curvature of the concave surface 213*a* of the connection part 213 deceases from an upstream side to a downstream side just before the second water-spouting port 32 in a flow direction of a first swirling flow (a washing water W12), a configuration may be provided so as to decrease from an upstream side to a downstream side just before the first water-spouting port 31 in a flow direction of a first swirling flow (a washing water W12).

Furthermore, although an embodiment as described above is configured in such a manner that washing waters W12, W22 are spouted from two water-spouting ports that are the first water-spouting port 31 and the second water-spouting port 32 so as to wash the bowl part 21, a configuration may be provided in such a manner that washing waters W are spouted from three or more water-spouting ports that include the first water-spouting port 31 and the second water-spouting port 32 so as to wash the bowl part 21.

3. Third Embodiment

3-1. General Configuration of Flush Toilet

Figure 6:
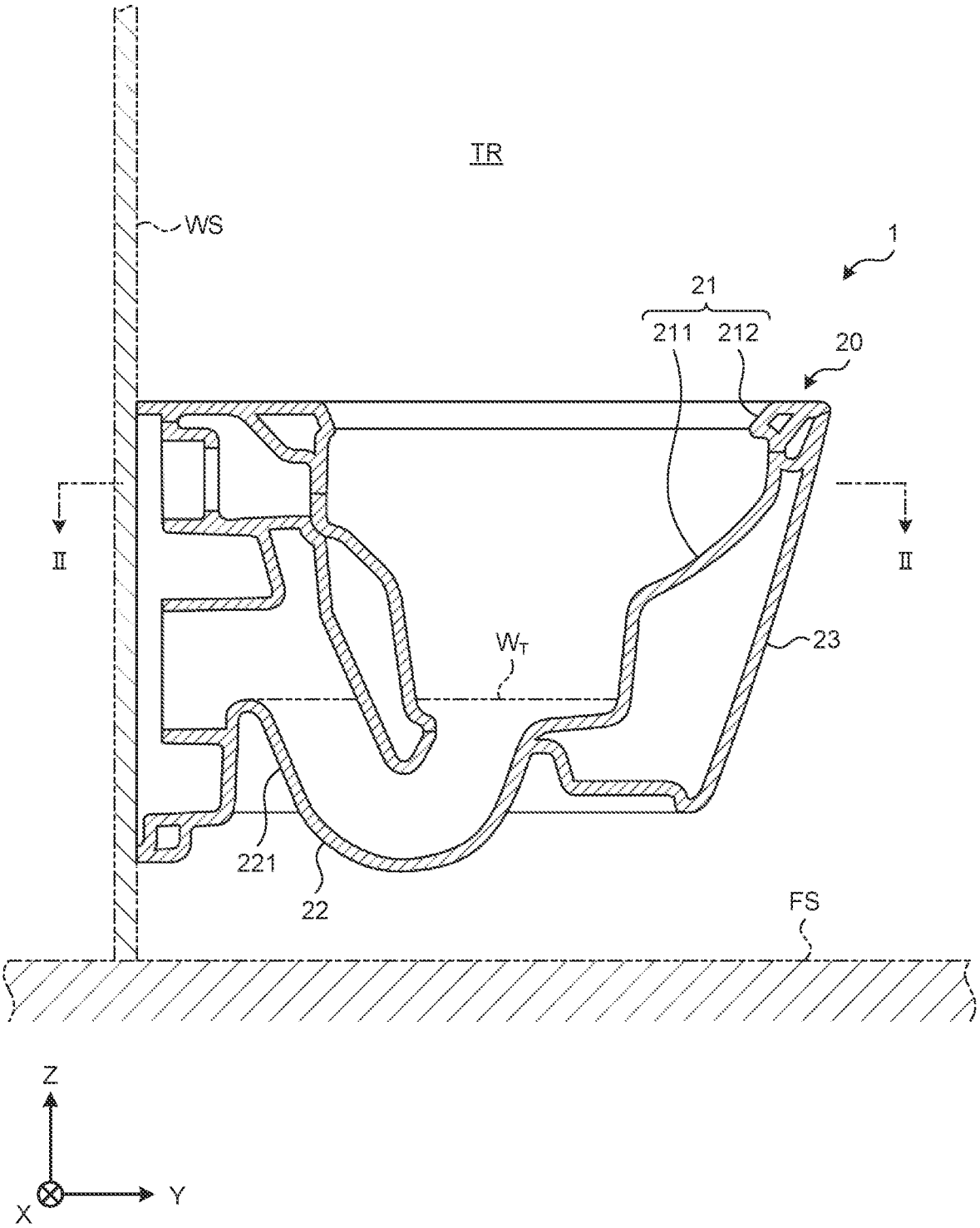
FIG. 6 is a schematic cross-sectional side view that illustrates a flush toilet according to a third embodiment.
Figure 7A:
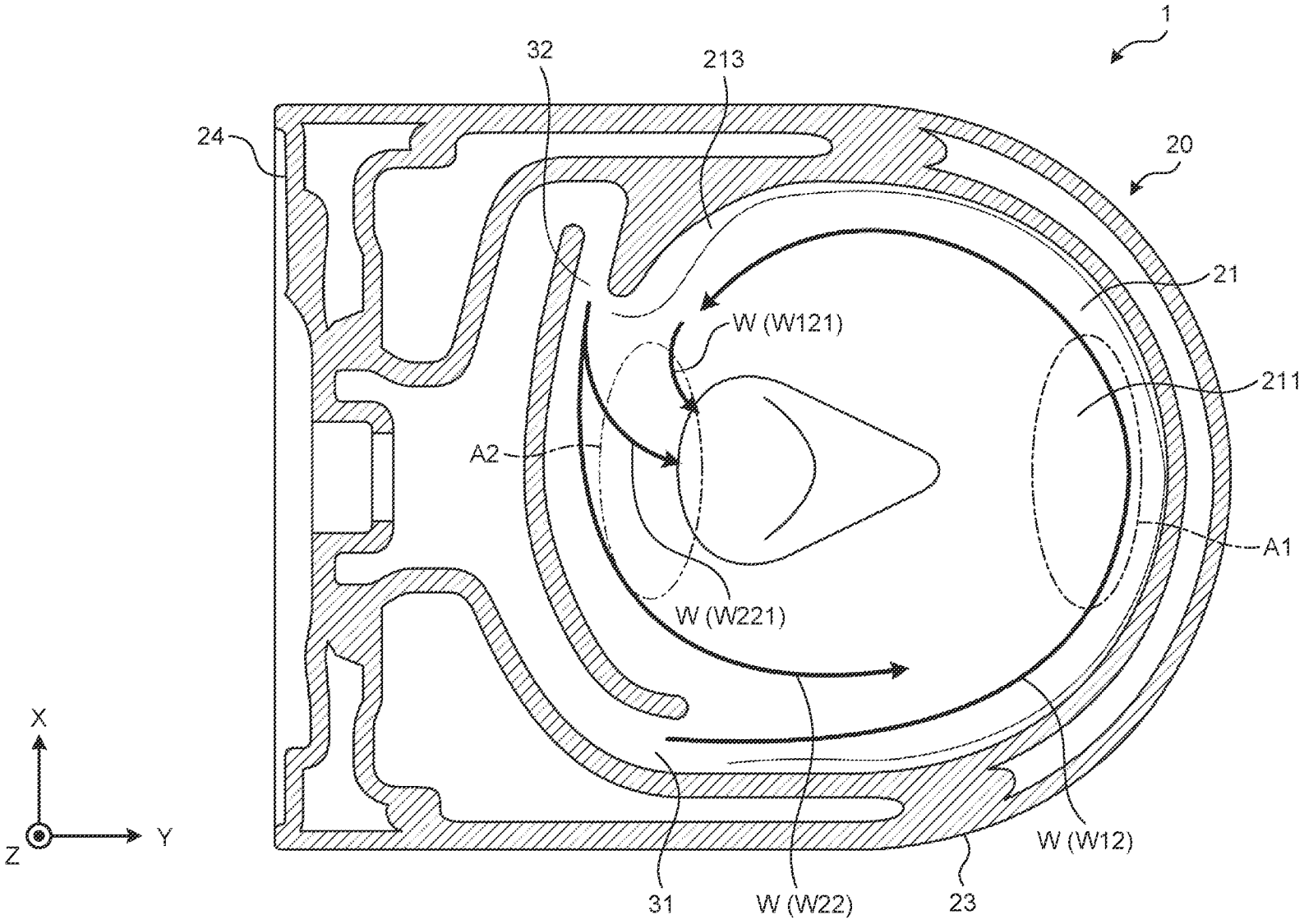
FIG. 7A is a cross-sectional view (part 1) along line II-II in FIG. 6.
Figure 7B:
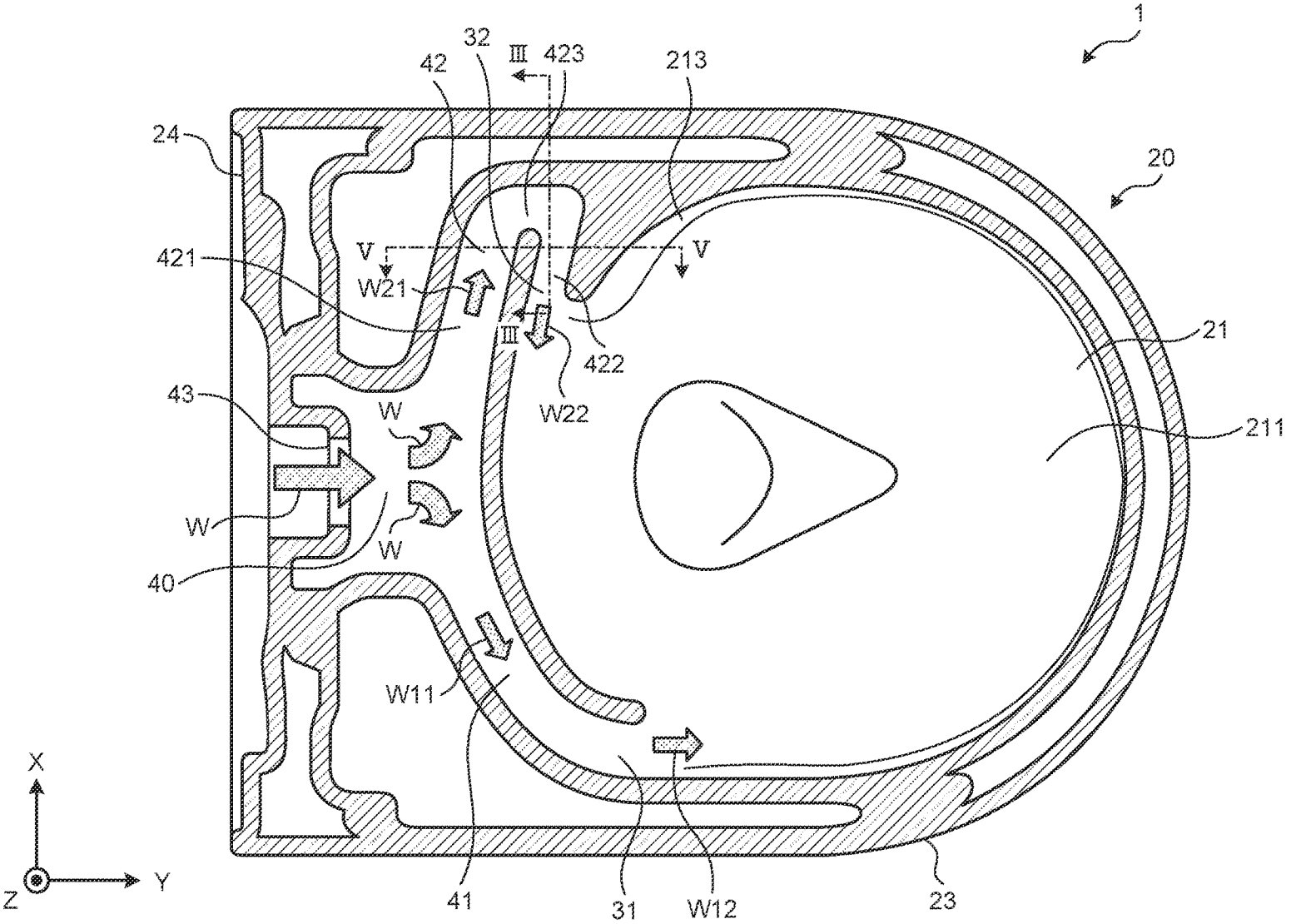
FIG. 7B is a cross-sectional view (part 2) along line II-II in FIG. 6.

A general configuration of a flush toilet 1 according to a third embodiment will be explained with reference to FIGS. 6, 7A, and 7B. FIG. 6 is a schematic cross-sectional side view that illustrates a flush toilet according to a third embodiment. FIGS. 7A and 7B are cross-sectional views along line II-II in FIG. 6. Additionally, FIG. 7A illustrates flows (swirling flows) of washing waters W12, W22 at a time of toilet washing. Furthermore, FIG. 7B illustrates flows of washing waters W11, W21 that are supplied to a first water-spouting port 31 and a second water-spouting port 32.

Furthermore, each figure illustrates a three-dimensional orthogonal coordinate system that includes a Z-axis where a vertically upward direction (an upper side) thereof is provided as a positive direction. Hereinafter, a positive direction of an X-axis, a negative direction of an X-axis, a positive direction of a Y-axis, and a negative direction of a Y-axis are defined as a left side, a right side, a front side, and a back side, respectively, and further, directions of an X-axis, directions of a Y-axis, and directions of a Z-axis are referred to as leftward and rightward directions, frontward and backward directions, and upward and downward directions, respectively, for explanatory convenience.

As illustrated in FIG. 6, a flush toilet 1 is a so-called wall-mounted type that is installed on a wall surface WS of a toilet room TR. Additionally, the flush toilet 1 may be a so-called floor-mounted type that is installed on a floor surface FS of a toilet room TR.

Furthermore, the flush toilet 1 is a so-called flush valve toilet where a washing water is supplied to a toilet body 20 as described later by a primary water pressure from a water supply source such as a water tap. Additionally, the flush toilet 1 may supply a washing water from, for example, a water storage tank that is provided as a water supply source that is attached to a back side of a wall surface WS, to the toilet body 20. Furthermore, a (non-illustrated) drain pipe for discharging waste is provided on a back side of a wall surface WS. A drain pipe is connected to a trap pipe line 22 of the toilet body 20 as described later through, for example, a (non-illustrated) drain socket, etc.

Furthermore, the flush toilet 1 (the toilet body 20) is made of a ceramic. Additionally, the flush toilet 1 is not limited to one that is made of a ceramic and may be made of a resin or may be manufactured by combining a ceramic and a resin.

Furthermore, a toilet seat (or a toilet seat device that has a function of washing a private part), a toilet seat cover, etc., that are not illustrated in the figure(s) are attached to the flush toilet 1 on an upper side of the toilet body 20.

As illustrated in FIGS. 6, 7A, and 7B, the flush toilet 1 includes a toilet body 20. The toilet body 20 includes a bowl part 21, a trap pipe line 22, a skirt part 23, and a back surface 24. Furthermore, the flush toilet 1 includes a plurality of water-spouting ports (a first water-spouting port 31 and a second water-spouting port 32). Furthermore, the flush toilet 1 includes a main water conduit 40, a first rim water conduit 41, and a second rim water conduit 42.

The bowl part 21 includes a waste-receiving surface 211, a rim part 212, and a connection part 213. The waste-receiving surface 211 is a site that receives waste and is formed into a bowl shape (a concave shape). The rim part 212 is provided so as to extend upward on an upper edge part of the waste-receiving surface 211. The rim part 212 is formed into a ring shape along an upper edge part of the waste-receiving surface 211.

The connection part 213 connects the waste-receiving surface 211 and the rim part 212. The connection part 213 has a concave surface 213*a* as described later on an upper surface (a front surface) thereof so as to connect the waste-receiving surface 211 and the rim part 212 smoothly. The connection part 213 will be described later, by using FIG. 10, etc.

A predetermined amount of a pooled water $W_T$ is stored or pooled in a bottom part of the bowl part 21 (the waste-receiving surface 211). Furthermore, the trap pipe line 22 is connected to a bottom part of the bowl part 21.

The trap pipe line 22 is communicated with a bottom part of the bowl part 21. Furthermore, the trap pipe line 22 is a pipe line that extends backward from a bottom part of the bowl part 21. The trap pipe line 22 discharges waste that is received by the waste-receiving surface 211 of the bowl part 21 to a drain pipe that is an external pipe. Furthermore, the trap pipe line 22 defines a water level of a pooled water $W_T$ that is formed on a bottom part of the bowl part 21, by a top part of an ascending part 221 that is sloped so as to ascend toward a back side thereof.

The skirt part 23 is provided so as to cover a side part of the bowl part 21 on one of left and right sides thereof to a side surface thereof on another of the left and right sides through a front part thereof. The skirt part 23 composes an appearance of the flush toilet 1.

The back surface 24 is provided on a back side of the bowl part 21. The back surface 24 is fixed on a wall surface WS of a toilet room TR by, for example, attaching an (non-illustrated) attachment tool(s) to an (non-illustrated) attachment hole(s) thereof. Thus, the back surface 24 is fixed on a wall surface WS, so that the flush toilet 1 is fixed on the wall surface WS.

As illustrated in FIGS. 7A and 7B, the flush toilet 1 includes a plurality of water-spouting ports that spout a washing water W to the bowl part 21 in order to wash the bowl part 21 (the waste-receiving surface 211). The flush toilet 1 includes a first water-spouting port 31 and a second water-spouting port 32. The first water-spouting port 31 is arranged on a back part of the bowl part 21 and spouts a washing water W toward the rim part 212. The first water-spouting port 31 spouts a washing water W12 from a back side of the waste-receiving surface 211 on one of left and right sides (for example, a right side) thereof.

The first water-spouting port 31 forms a first flow (a first swirling flow) of a washing water W12 that swirls on the waste-receiving surface 211. That is, a washing water W that is spouted from the first water-spouting port 31 is provided as a first swirling flow (a washing water W12) that swirls on the waste-receiving surface 211 and the connection part 213 by centrifugal force.

The second water-spouting port 32 is arranged on back part of the bowl part 21 and spouts a washing water W toward the rim part 212. The second water-spouting port 32 spouts a washing water W22 from a back side of the waste-receiving surface 211 on another of left and right sides (for example, a left side) thereof.

The second water-spouting port 32 joins a first swirling flow (a washing water W12) and forms, together with the first swirling flow (the washing water W12), a second flow (a second swirling flow) of a washing water W22 that swirls on the waste-receiving surface 211. That is, a washing water W22 that is spouted from the second water-spouting port 32 is provided as a second swirling flow (a washing water W22) that swirls on the waste-receiving surface 211 and the connection part 213, by centrifugal force, similarly to a first swirling flow (a washing water W12). Additionally, a first swirling flow (a washing water W12) and a second swirling flow (a washing water W22) may swirl where a part on the rim part 212 is included.

Thus, washing waters W (W12, W22) that are spouted from the first water-spouting port 31 and the second water-spouting port 32 swirl so as to be provided as a first swirling flow (a washing water W12) that flows into the trap pipe line 22 and a second swirling flow (a washing water W22), respectively. In the flush toilet 1, the waste-receiving surface 211 is washed (tornado-washed) with such a first swirling flow (a washing water W12) and a second swirling flow (a washing water W22).

As illustrated in FIG. 7B, the flush toilet 1 includes a main water conduit 40, a first rim water conduit 41, and a second rim water conduit 42. The main water conduit 40 extends frontward from a supply port 43 for a washing water W in the flush toilet 1. A washing water W for being supplied to the bowl part 21 flows through the main water conduit 40. A washing water W that flows through the main water conduit 40 is branched into leftward and rightward directions on a downstream side where one thereof is supplied to a first rim water conduit 41 as described later and another thereof is supplied to a second rim water conduit 42 as described later.

The first rim water conduit 41 is arranged on an upstream side of the first water-spouting port 31. A washing water W11 that is branched from the main water conduit 40 flows through the first rim water conduit 41. The first water-spouting port 31 is formed on a downstream end part of the first rim water conduit 41. That is, a washing water W11 that is supplied to the first water-spouting port 31 flows through the first rim water conduit 41.

The second rim water conduit 42 is arranged on an upstream side of the second water-spouting port 32. A washing water W21 that is branched from the main water conduit 40 flows through the second rim water conduit 42. The second water-spouting port 32 is formed on a downstream end part of the second rim water conduit 42. That is, a washing water W21 that is supplied to the second water-spouting port 32 flows through the second rim water conduit 42.

Furthermore, the second rim water conduit 42 includes an upstream side water conduit 421, a downstream side water conduit 422, and a bending part 423. The upstream side water conduit 421 extends toward a left side in such a manner that a washing water W21 that is branched from the main water conduit 40 flows to, for example, a left side. The downstream side water conduit 422 extends toward an opposite direction of a direction where the upstream side water conduit 421 extends (for example, toward a right side). The second water-spouting port 32 is formed on a downstream end part of the downstream side water conduit 422.

The bending part 423 is provided so as to connect the upstream side water conduit 421 and the downstream side water conduit 422 on a downstream end part of the upstream side water conduit 421 and an upstream end part of the downstream side water conduit 422. Such a bending part 423 changes a flow direction of a washing water W21 that is supplied to the second water-spouting port 32 to an opposite direction thereof, in the second rim water conduit 42.

Herein, in a case where water force of a washing water W that is spouted from the first water-spouting port 31 is strong, such as a flush valve toilet, a washing water W12 that swirls on the bowl part 21 by centrifugal force maintains swirling force even in a back part area A2 of the bowl part 21 (the waste-receiving surface 211), so that a washing water W may be prevented from readily flowing downward in the back part area A2 of the waste-receiving surface 211. Hence, leaving a part unwashed may occur in an area of the waste-receiving surface 211 under the second water-spouting port 32 where a washing water W12 does not readily flow downward, that is, a back part area A2 of the waste-receiving surface 211.

In a case where a bottom surface 422*b* of the downstream side water conduit 422 of the second rim water conduit 42 is flat, a washing water W22 is spouted substantially horizontally from the second water-spouting port 32, so that it is considered that the washing water W22 does not readily flow to an area under the second water-spouting port 32 (a back part area A2 of the waste-receiving surface 211). Hence, in the present embodiment, the bottom surface 422*b* of the downstream side water conduit 422 of the second rim water conduit 42 has a sloping part 422*b*1 that slopes downward toward a downstream side, and thereby, forms a downward flow of a washing water W22 toward an area under the second water-spouting port 32 (a back part area A2 of the waste-receiving surface 211).

3-2. Second Rim Water Conduit

Figure 8A:
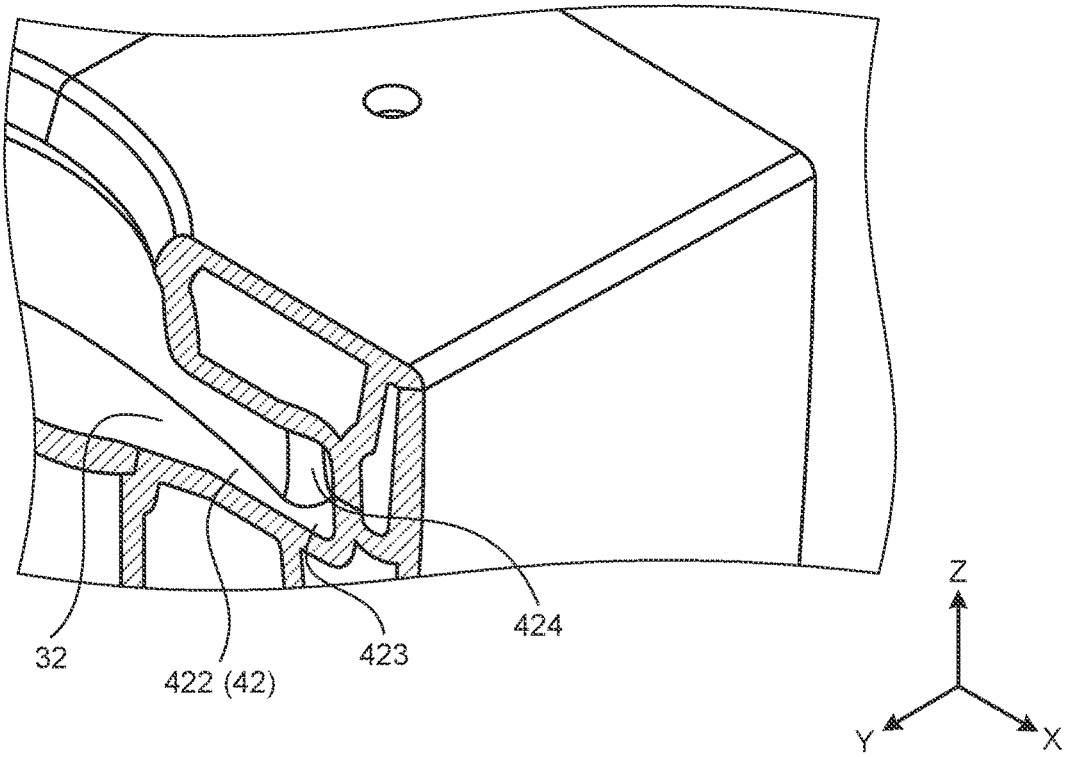
FIG. 8A is a schematic cross-sectional view (part 1) along line III-III in FIG. 7B.
Figure 8B:
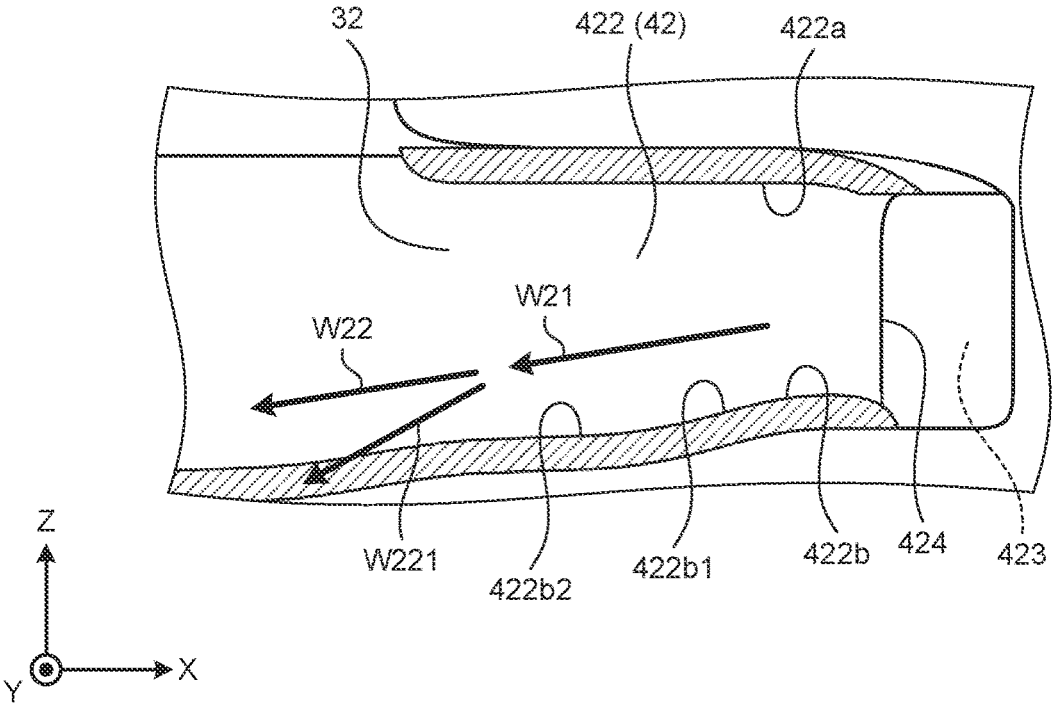
FIG. 8B is a schematic cross-sectional view (part 2) along line III-III in FIG. 7B.
Figure 9:
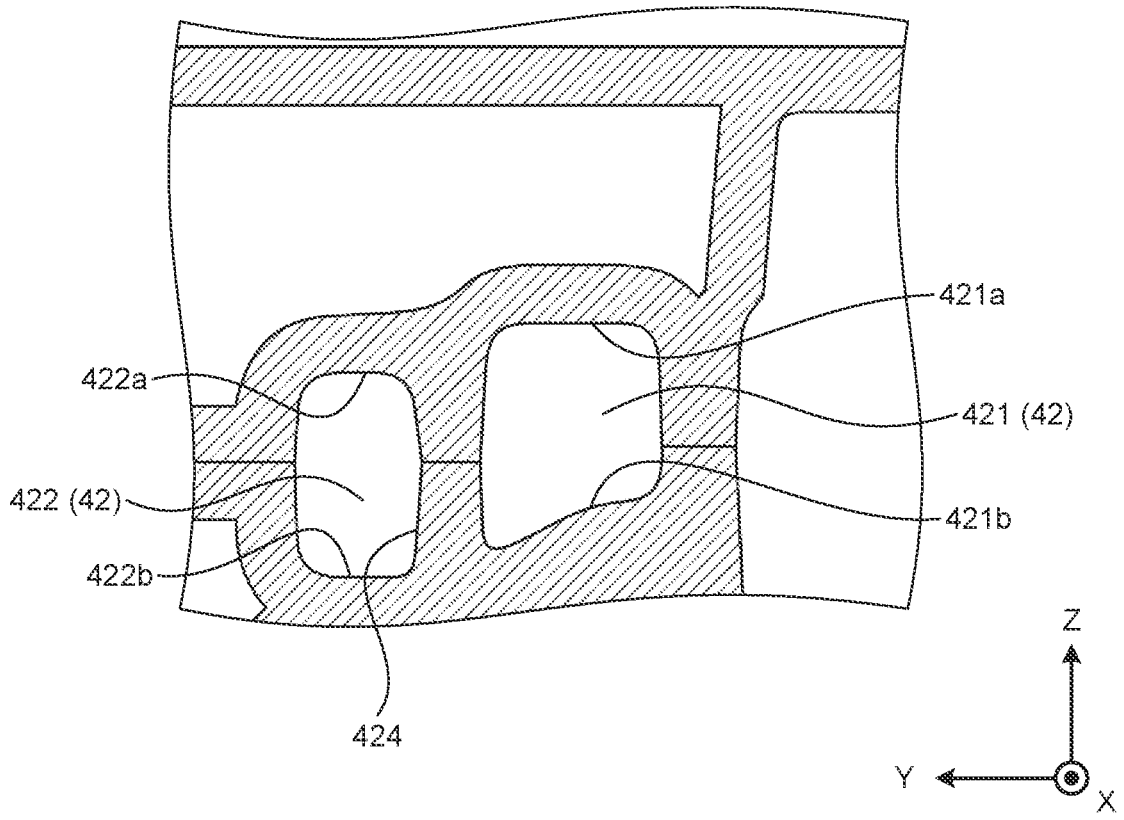
FIG. 9 is a schematic cross-sectional view along line V-V in FIG. 7B.

Next, a second rim water conduit 42 will be explained with reference to FIGS. 8A, 8B, and 9. FIGS. 8A and 8B are schematic cross-sectional views along line III-III in FIG. 7B. Additionally, FIG. 8A illustrates a schematic (cross-sectional) perspective view of a downstream side water conduit 422 of a second rim water conduit 42. Furthermore, FIG. 8B illustrates a schematic cross-sectional front elevation view of the downstream side water conduit 422 of the second rim water conduit 42. FIG. 9 is a schematic cross-sectional view along line V-V in FIG. 7B. Additionally, FIG. 9 illustrates a schematic cross-sectional side view of an upstream side water conduit 421 and the downstream side water conduit 422 of the second rim water conduit 42.

As described above, the second rim water conduit 42 includes the upstream side water conduit 421, the downstream side water conduit 422, and a bending part 423. Additionally, the upstream side water conduit 421 and the downstream side water conduit 422 are separated by a partition wall 424 in frontward and backward directions.

As illustrated in FIGS. 8A and 8B, the downstream side water conduit 422 includes a top surface 422*a* and a bottom surface 422*b*. A length (a height) of the downstream side water conduit 422 in upward and downward directions is defined by the top surface 422*a* and the bottom surface 422*b*.

As illustrated in FIG. 8B, the bottom surface 422*b* includes a sloping part 422*b*1 and a flat part 422*b*2. The sloping part 422*b*1 is a sloping surface that is formed in such a manner that the bottom surface 422*b* slopes downward toward a downstream side. Hence, the bottom surface 422*b* is formed by the sloping part 422*b*1 so as to spread toward a downstream side. Furthermore, the sloping part 422*b*1 is arranged on a downstream side of the bending part 423. It is preferable that the sloping part 422*b*1 is arranged just after the bending part 423 on a downstream side thereof.

Such a sloping part 422*b*1 acts on a washing water W21 that flows through the downstream side water conduit 422 so as to have a vector with a downward direction in such a manner that the washing water W21 flows downward.

The flat part 422*b*2 is a surface (a flat surface) that is formed in such a manner that the bottom surface 422*b* is substantially flat. The flat part 422*b*2 is a surface with a slope angle that is closer to a horizontal one than that of the sloping part 422*b*1. The flat part 422*b*2 is arranged on a downstream side of the sloping part 422*b*1. It is preferable that the flat part 422*b*2 is arranged just after the sloping part 422*b*1 on a downstream side thereof.

Such a flat part 422*b*2 acts on a washing water W21 that flows through the downstream side water conduit 422 in such a manner that a flow of the washing water W21 is regulated.

As illustrated in FIG. 9, the top surface 422*a* of the downstream side water conduit 422 are formed in such a manner that a height thereof is less than that of a top surface 421*a* of the upstream side water conduit 421 that is provided on an upstream side of the downstream side water conduit 422 where the bending part 423 is interposed therebetween. Thus, the top surface 422*a* of the downstream side water conduit 422 is lower than the top surface 421*a* of the upstream side water conduit 421, so that a washing water W21 that flows through the second rim water conduit 42 has a vector with a downward direction toward a downstream side.

Furthermore, as illustrated in FIG. 9, the bottom surface 422*b* of the downstream side water conduit 422 is formed in such a manner that a height thereof is less than that of a bottom surface 421*b* of the upstream side water conduit 421. Also in a case where the bottom surface 422*b* of the downstream side water conduit 422 is lower than the bottom surface 421*b* of the upstream side water conduit 421, a washing water W21 that flows through the second rim water conduit 42 has a vector with a downward direction toward a downstream side.

As illustrated in FIG. 8B, in the second rim water conduit 42, a washing water W21 that flows through the downstream side water conduit 422 has a vector with a downward direction toward a downstream side, and a washing water W22 that is spouted from the second water-spouting port 32 that is formed on a downstream end part of the downstream side water conduit 422 includes a downward flow (a washing water W221).

3-3. Mode of Second Flow (Second Swirling Flow)

Figure 10:
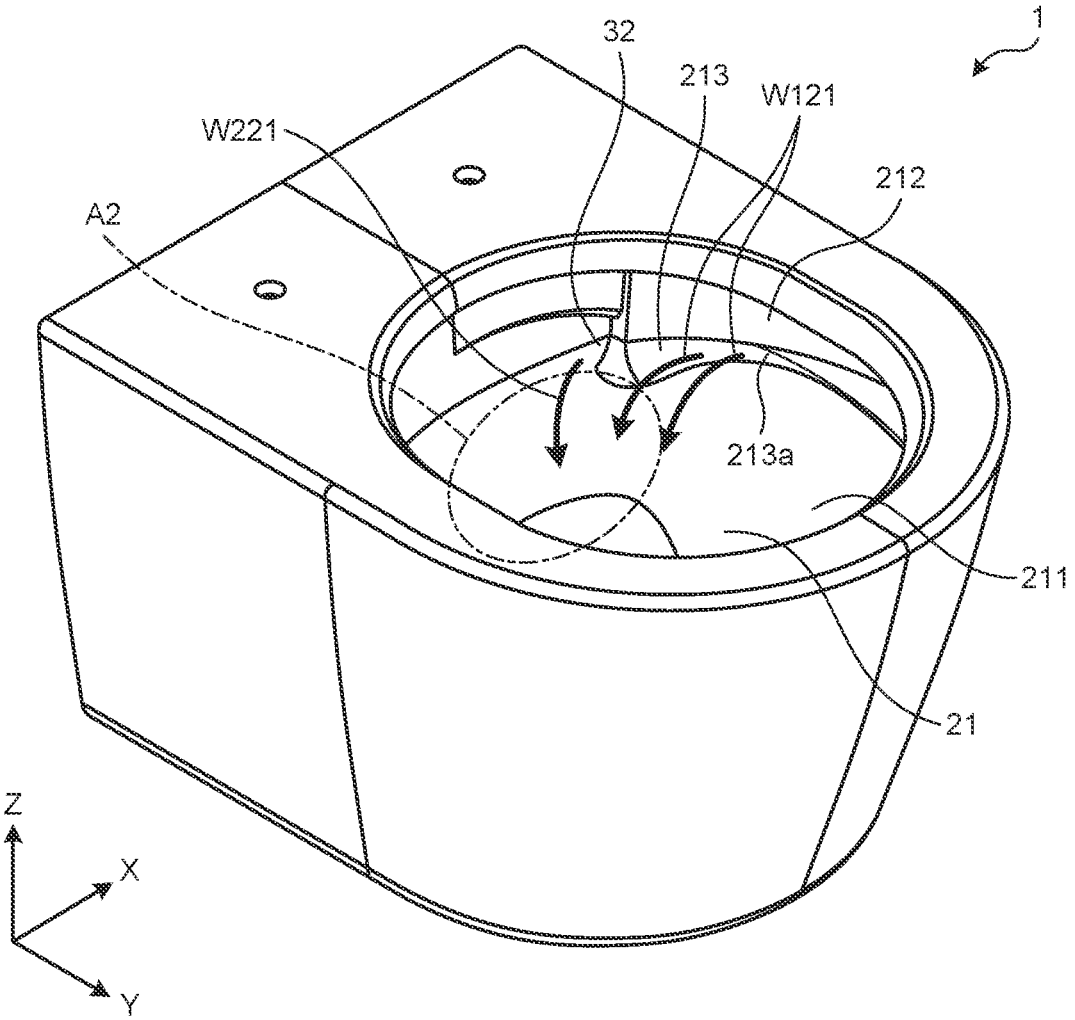
FIG. 10 is an explanatory diagram for a first flow (a first swirling flow) and a second flow (a second swirling flow) of a washing water in a flush toilet according to a third embodiment.

Next, a mode of a second flow (a second swirling flow) of a washing water W22 (W221) will be explained with reference to FIG. 10. FIG. 10 is an explanatory diagram for a first flow (a first swirling flow) and a second flow (a second swirling flow) of a washing water W in a flush toilet 1 according to a third embodiment.

A second rim water conduit 42 (a downstream side water conduit 422) has a sloping part 422*b*1 (see FIG. 8B), etc., so as to have a vector with a downward direction in such a manner that a washing water W221 that is spouted from a second water-spouting port 32 flows downward.

Hence, as illustrated in FIG. 10, a washing water W221 flows into an area under the second water-spouting port 32, that is, a back part area A2 of a waste-receiving surface 211. Then, a washing water W221 that flows into a back part area A2 of the waste-receiving surface 211 washes the back part area A2 of the waste-receiving surface 211.

Furthermore, as illustrated in FIG. 10, it is preferable that a first flow (a first swirling flow) of a washing water W12 that is spouted from a first water-spouting port 31 (see FIGS. 7A and 7B) also flows toward a back part area A2 of the waste-receiving surface 211.

3-4. Concave Surface of Connection Part

Herein, a concave surface 213*a* of a connection part 213 will be explained that is provided in such a manner that a washing water W12 that is spouted from a first water-spouting port 31 forms a flow toward a back part area A2 of a waste-receiving surface 211.

The connection part 213 that connects the waste-receiving surface 211 and a rim part 212 has the concave surface 213*a* that is curved downward so as to have a predetermined curvature, on an upper surface (a front surface) thereof. Furthermore, the concave surface 213*a* of the connection part 213 is curved so as to have a curvature that decreases from an upstream side to a downstream side just before a second water-spouting port 32 (see FIGS. 7A and 7B) in a flow direction of a washing water W12 on a first swirling flow.

Furthermore, the concave surface 213*a* of the connection part 213 is formed in such a manner that a length thereof in upward and downward directions gradually increases from an upstream side to a downstream side in a flow direction of a washing water W12 on a first swirling flow. In other words, the concave surface 213*a* of the connection part 213 is provided in such a manner that an occupancy of a bowl part 21 (see FIGS. 7A and 7B) in upward and downward directions increases from an upstream side to a downstream side in a flow direction of a washing water W12 on a first swirling flow.

Furthermore, the connection part 213 is formed in such a manner that a starting point in a flow direction of a washing water W12 on a first swirling flow where a curvature of the concave surface 213*a* starts to decrease is positioned at a back side of a center of the bowl part 21 in frontward and backward directions.

3-5. Mode of First Flow (First Swirling Flow)

A curvature of a concave surface 213*a* of a connection part 213 decreases from an upstream side to a downstream side just before a second water-spouting port 32 in a flow direction of a first swirling flow (a washing water W12) (see FIG. 7A), so that a washing water W12 that is spouted from a first water-spouting port 31 (see FIG. 7A) increases a vector with a downward direction on the concave surface

213*a* of the connection part 213 that is positioned just before the second water-spouting port 32.

Hence, as illustrated in FIG. 10, a first swirling flow (a washing water W12) includes a downward flow (a washing water W121) just before the second water-spouting port 32. Then, such a washing water W121 is provided as a flow toward a back part area A2 of a waste-receiving surface 211 so as to wash the back part area A2 of the waste-receiving surface 211.

In the flush toilet 1 according an embodiment as described above, the bottom surface 422*b* of the second rim water conduit 42 (the downstream side water conduit 422) has the sloping part 422*b*1 that slopes downward toward a downstream side, on a downstream side of the bending part 423 of the second rim water conduit 42 where a washing water W21 that is supplied to the second water-spouting port 32 flows, so that, as the washing water W21 flows through the sloping part 422*b*1, a washing water W221 that is spouted from the second water-spouting port 32 has a vector with a downward direction so as to flow downward. Hence, even in the flush toilet 1 where a washing water W12 with strong water force is spouted from the first water-spouting port 31, such as a flush valve toilet, it is possible to cause a washing water W221 to flow downward to an area under the second water-spouting port 32 (a back part area A2 of the waste-receiving surface 211). Thereby, it is possible to reduce or prevent occurrence of leaving a part of a back part area A2 of the waste-receiving surface 211 unwashed, so that it is possible to improve a washing performance for the waste-receiving surface 211.

Furthermore, the sloping part 422*b*1 is arranged just after the bending part 423 on a downstream side thereof, so that a washing water W221 that is spouted from the second water-spouting port 32 has a vector with a downward direction so as to flow downward. Hence, even in the flush toilet 1 where a washing water W12 with strong water force is spouted from the first water-spouting port 31, such as a flush valve toilet, it is possible to cause a washing water W221 to flow downward to an area under the second water-spouting port 32 (a back part area A2 of the waste-receiving surface 211). Thereby, it is possible to reduce or prevent occurrence of leaving a part of a back part area A2 of the waste-receiving surface 211 unwashed, so that it is possible to improve a washing performance for the waste-receiving surface 211.

Furthermore, the second rim water conduit 42 (the downstream side water conduit 422) has the flat part 422*b*2 on a downstream side of the sloping part 422*b*1, so that it is possible to provide a configuration in such a manner that a washing water W221 that is spouted from the second water-spouting port 32 has a vector with a downward direction so as to flow downward and a flow of a washing water W21 is regulated just before being spouted from the second water-spouting port 32. Hence, even in the flush toilet 1 where a washing water W12 with strong water force is spouted from the first water-spouting port 31, such as a flush valve toilet, it is possible to cause a washing water W221 to flow downward to an area under the second water-spouting port 32 (a back part area A2 of the waste-receiving surface 211) and it is possible to enhance washing power of a washing water W221 with a regulated flow. Thereby, it is possible to reduce or prevent occurrence of leaving a part of a back part area A2 of the waste-receiving surface 211 unwashed, so that it is possible to improve a washing performance for the waste-receiving surface 211.

Furthermore, the top surface 422*a* of the downstream side water conduit 422 is lower than the top surface 421*a* of the upstream side water conduit 421, so that a washing water W21 that flows through the second rim water conduit 42 has a vector with a downward direction toward a downstream side, by the top surface 422*a*, where the washing water W21 is readily influenced by a shape of the sloping part 422*b*1, and as the washing water W21 flows through the sloping part 422*b*1, a washing water W221 that is spouted from the second water-spouting port 32 has a vector with a downward direction so as to flow downward. Hence, even in the flush toilet 1 where a washing water W12 with strong water force is spouted from the first water-spouting port 31, such as a flush valve toilet, it is possible to cause a washing water W221 to flow downward to an area under the second water-spouting port 32 (a back part area A2 of the waste-receiving surface 211). Thereby, it is possible to reduce or prevent occurrence of leaving a part of a back part area A2 of the waste-receiving surface 211 unwashed, so that it is possible to improve a washing performance for the waste-receiving surface 211.

Furthermore, a curvature of the concave surface 213*a* of the connection part 213 decreases from an upstream side to a downstream side just before the second water-spouting port 32 in a flow direction of a first swirling flow (a washing water W12), so that it is possible for a shape of such a connection part 213 to increase a vector with a downward direction for a washing water W121 that swirls on the waste-receiving surface 211 by centrifugal force and to spread a water flux of a washing water W121 that flows in a concentrated manner, in a fan-like form, toward a back part of the waste-receiving surface 211. Hence, even in the flush toilet 1 where a washing water W12 with strong water force is spouted from the first water-spouting port 31, such as a flush valve toilet, it is possible to cause a washing water W121 to flow downward to an area under the second water-spouting port 32 (a back part area A2 of the waste-receiving surface 211) and wash a wide area of a back part of the bowl part 21 (a back part of the waste-receiving surface 211). Thereby, it is possible to reduce or prevent occurrence of leaving a part of a back part area A2 of the waste-receiving surface 211 unwashed, so that it is possible to improve a washing performance for the waste-receiving surface 211.

Furthermore, an occupancy of the connection part 213 in upward and downward directions increases from an upstream side to a downstream side in a flow direction of a first swirling flow (a washing water W12), so that it is possible to further increase a vector with a downward direction for a washing water W12 (W121) that swirls on the waste-receiving surface 211 by centrifugal force. Hence, even in the flush toilet 1 where a washing water W12 with strong water force is spouted from the first water-spouting port 31, such as a flush valve toilet, it is possible to cause a washing water to flow downward from a top part to a bottom part on the waste-receiving surface 211. Thereby, it is possible to reduce or prevent occurrence of leaving a part of the waste-receiving surface 211 unwashed, so that it is possible to improve a washing performance for the waste-receiving surface 211.

Furthermore, a starting point where a curvature of the concave surface 213*a* of the connection part 213 decreases is positioned at a back side of a center of the bowl part 21 in frontward and backward directions, so that it is possible to cause a washing water W12 (W121) to flow downward in a back part area A2 of the bowl part 21 (the waste-receiving surface 211) while preventing water force of a washing water W12 from dropping in a front part area A1 (see FIG. 7) of the bowl part 21 (the waste-receiving surface 211).

Hence, even in the flush toilet 1 where a washing water W12 with strong water force is spouted from the first water-spouting port 31, such as a flush valve toilet, it is possible to cause a washing water W12 (W121) to flow downward from a top part to a bottom part on the waste-receiving surface 211. Thereby, it is possible to reduce or prevent occurrence of leaving a part of the waste-receiving surface 211 unwashed, so that it is possible to improve a washing performance for the waste-receiving surface 211.

Furthermore, a starting point where a curvature of the concave surface 213*a* of the connection part 213 decreases is positioned at a back side of a center of the bowl part 21 in frontward and backward directions, so that it is possible to a washing water W121 to flow downward while a water flux of such a washing water W121 is prevented from excessively spreading downward. Thereby, it is possible to reduce or prevent occurring of an unwashed state of an upper end part of the waste-receiving surface 211.

Additionally, although an embodiment as described above is configured in such a manner that a curvature of the concave surface 213*a* of the connection part 213 deceases from an upstream side to a downstream side just before the second water-spouting port 32 in a flow direction of a first swirling flow (a washing water W12), a configuration may be provided so as to decrease from an upstream side to a downstream side just before the first water-spouting port 31 in a flow direction of a first swirling flow (a washing water W12).

Furthermore, although an embodiment as described above is configured in such a manner that washing waters W12, W22 are spouted from two water-spouting ports that are the first water-spouting port 31 and the second water-spouting port 32 so as to wash the bowl part 21, a configuration may be provided in such a manner that washing waters W are spouted from three or more water-spouting ports that include the first water-spouting port 31 and the second water-spouting port 32 so as to wash the bowl part 21.

An aspect of an embodiment aims to provide a flush toilet that is capable of improving a washing performance for a waste-receiving surface.

A flush toilet according to an aspect of an embodiment includes a bowl part that has a waste-receiving surface with a bowl shape that receives waste and a rim part that extends upward on an upper edge part of the waste-receiving surface, a trap pipe line that is communicated with a bottom part of the bowl part and extends from the bottom part, and discharges waste that is received by the waste-receiving surface, a first water-spouting port that spouts a washing water toward the rim part so as to form a first flow of a washing water that swirls on the waste-receiving surface, a second water-spouting port that spouts a washing water toward the rim part so as to form a second flow of a washing water that joins the first flow, and a connection part that has a concave surface that connects the waste-receiving surface and the rim part and is curved so as to have a curvature that decreases from an upstream side to a downstream side of the first flow just before the first water-spouting port or the second water-spouting port in a flow direction of the first flow.

In such a configuration, a curvature of a concave surface of a connection part that connects a waste-receiving surface and a rim part decreases from an upstream side to a downstream side just before a first water-spouting port or a second water-spouting port in a flow direction of a first flow, so that it is possible for a shape of such a connection part to increase a vector with a downward direction for a washing water that swirls on the waste-receiving surface by centrifugal force. Hence, for example, even in a flush toilet where a washing water with strong water force is spouted from a first water-spouting port, it is possible to cause a washing water to flow downward from a top part to a bottom part on a waste-receiving surface. Thereby, it is possible to reduce or prevent occurrence of leaving a part of a waste-receiving surface unwashed, so that it is possible to improve a washing performance for the waste-receiving surface.

Furthermore, in the flush toilet as described above, the connection part is provided in such a manner that an occupancy of the connection part in upward and downward directions increases from an upstream side to a downstream side of the first flow.

In such a configuration, an occupancy of a connection part in upward and downward directions increases from an upstream side to a downstream side of a first flow, so that it is possible to increase a vector with a downward direction for a washing water that swirls on a waste-receiving surface by centrifugal force. Hence, for example, even in a flush toilet where a washing water with strong water force is spouted from a first water-spouting port, it is possible to cause a washing water to flow downward from a top part to a bottom part on a waste-receiving surface. Thereby, it is possible to reduce or prevent occurrence of leaving a part of a waste-receiving surface unwashed, so that it is possible to improve a washing performance for the waste-receiving surface.

Furthermore, in the flush toilet as described above, the second water-spouting port is arranged on a back part of the bowl part, and the connection part has a concave surface that is curved so as to have a curvature that decreases from an upstream side to a downstream side of the first flow just before the second water-spouting port in a flow direction of the first flow.

In such a configuration, a curvature of a concave surface of a connection part that connects a waste-receiving surface and a rim part decreases from an upstream side to a downstream side just before a second water-spouting port in a flow direction of a first flow, so that it is possible for a shape of such a connection part to increase a vector with a downward direction for a washing water that swirls on the waste-receiving surface by centrifugal force, and it is possible to spread a water flux of a washing water that flows in a concentrated manner, in a fan-like form, toward a back part of the waste-receiving surface. Hence, for example, even in a flush toilet where a washing water with strong water force is spouted from a first water-spouting port, it is possible to cause a washing water to flow downward from a top part to a bottom part on a waste-receiving surface and wash a wide area of a back part of a bowl part (a back part of the waste-receiving surface). Thereby, it is possible to reduce or prevent occurrence of leaving a part of a waste-receiving surface unwashed, so that it is possible to improve a washing performance for the waste-receiving surface.

Furthermore, in the flush toilet as described above, the connection part is provided in such a manner that a starting point in the flow direction where a curvature of the concave surface decreases is positioned at a back side of a center of the bowl part in frontward and backward directions.

In such a configuration, a curvature of a concave surface of a connection part that connects a waste-receiving surface and a rim part decreases from an upstream side to a downstream side just before a second water-spouting port in a flow direction of a first flow, and further, a starting point where a curvature of the concave surface of the connection part decreases is positioned at a back side of a center of a bowl part in frontward and backward directions, so that it is possible to increase a vector with a downward direction for a washing water that swirls on the waste-receiving surface by centrifugal force. Furthermore, it is possible to cause a washing water to flow downward in a back part area of a bowl part (a waste-receiving surface) while preventing water force of a washing water from dropping in a front part area of the bowl part (the waste-receiving surface). Hence, for example, even in a flush toilet where a washing water with strong water force is spouted from a first water-spouting port, it is possible to cause a washing water to flow downward from a top part to a bottom part on a waste-receiving surface. Thereby, it is possible to reduce or prevent occurrence of leaving a part of a waste-receiving surface unwashed, so that it is possible to improve a washing performance for the waste-receiving surface.

Furthermore, in the flush toilet as described above, the connection part occupies half or more of a distance from a lowermost end of the connection part to an uppermost end of the rim part on a downstream side of the starting point.

In such a configuration, a connection part occupies half or more of a distance from a lowermost end of the connection part to an uppermost end of a rim part on a downstream side of a starting point where a curvature of a concave surface decreases, so that it is possible to increase a vector with a downward direction for a washing water that swirls on a waste-receiving surface by centrifugal force. Furthermore, it is possible to cause a washing water to flow downward in a back part area of a bowl part (a waste-receiving surface) while preventing water force of a washing water from dropping in a front part area of the bowl part (the waste-receiving surface). Hence, for example, even in a flush toilet where a washing water with strong water force is spouted from a first water-spouting port, it is possible to cause a washing water to flow downward from a top part to a bottom part on a waste-receiving surface. Thereby, it is possible to reduce or prevent occurrence of leaving a part of a waste-receiving surface unwashed, so that it is possible to improve a washing performance for the waste-receiving surface.

A flush toilet according to an aspect of an embodiment includes a bowl part that has a waste-receiving surface with a bowl shape that receives waste and a rim part that extends upward on an upper edge part of the waste-receiving surface, a trap pipe line that is communicated with a bottom part of the bowl part and extends from the bottom part, and discharges waste that is received by the waste-receiving surface, a first water-spouting port that spouts a washing water toward the rim part so as to form a first flow of a washing water that swirls on the waste-receiving surface, a first rim water conduit that is positioned at an upstream side of the first water-spouting port where a washing water that is supplied to the first water-spouting port flows, a second water-spouting port that spouts a washing water toward the rim part so as to form a second flow of a washing water that joins the first flow, and a second rim water conduit that is positioned at an upstream side of the second water-spouting port where a washing water that is supplied to the second water-spouting port flows, wherein the second rim water conduit has a bending part that changes a flow direction of a washing water that is supplied to the second water-spouting port to an opposite direction thereof and a sloping part where a bottom surface of the second rim water conduit slopes downward toward a downstream side, on a downstream side of the bending part.

In such a configuration, it has a sloping part where a bottom surface of a second rim water conduit slopes downward toward a downstream side, on a downstream side of a bending part of the second rim water conduit where a washing water that is supplied to a second water-spouting port flows, so that, as a washing water flows through the sloping part, a washing water that is spouted from the second water-spouting port has a vector with a downward direction so as to flow downward. Hence, for example, even in a flush toilet where a washing water with strong water force is spouted from a first water-spouting port, it is possible to cause a washing water to flow downward to a lower side area of a second water-spouting port. Thereby, it is possible to reduce or prevent occurrence of leaving a part of a waste-receiving surface unwashed in an area under a second water-spouting port, so that it is possible to improve a washing performance for the waste-receiving surface.

Furthermore, in the flush toilet as described above, the sloping part is arranged just after the bending part on a downstream side thereof.

In such a configuration, a sloping part is arranged just after a bending part on a downstream side thereof, a washing water that is spouted from a second water-spouting port has a vector with a downward direction so as to flow more downward. Hence, for example, even in a flush toilet where a washing water with strong water force is spouted from a first water-spouting port, it is possible to cause a washing water to flow downward to an area under a second water-spouting port. Thereby, it is possible to reduce or prevent occurrence of leaving a part of a waste-receiving surface unwashed in an area under a second water-spouting port, so that it is possible to improve a washing performance for the waste-receiving surface.

Furthermore, in the flush toilet as described above, the second rim water conduit further has a flat part where a slope angle thereof is closer to a horizontal one than that of the sloping part, on a downstream side of the sloping part.

In such a configuration, a second rim water conduit has a flat part on a downstream side of a sloping part, so that it is possible to provide a configuration in such a manner that a washing water that is spouted from a second water-spouting port has a vector with a downward direction so as to flow downward and a flow of a washing water is regulated just before being spouted from the second water-spouting port. Hence, for example, even in a flush toilet where a washing water with strong water force is spouted from a first water-spouting port, it is possible to cause a washing water to flow downward to an area under a second water-spouting port and it is possible to enhance washing power of a washing water with a regulated flow. Thereby, it is possible to reduce or prevent occurrence of leaving a part of a waste-receiving surface unwashed in an area under a second water-spouting port, so that it is possible to improve a washing performance for the waste-receiving surface.

Furthermore, in the flush toilet as described above, the second rim water conduit is provided in such a manner that a top surface of the bending part on a downstream side thereof, in a top surface of the second rim water conduit, is lower than a top surface of the bending part on an upstream side thereof.

In such a configuration, a top surface of a bending part on a downstream side thereof, in a top surface of a second rim water conduit, is lower than a top surface of the bending part on an upstream side thereof, so that a washing water that flows through a second rim water conduit has a vector with a downward direction by a top surface toward a downstream side, in such a manner that a washing water is readily influenced by a shape of a sloping part, and as a washing water flows through the sloping part, a washing water that is spouted from a second water-spouting port has a vector with a downward direction so as to flow downward. Hence, for example, even in a flush toilet where a washing water with strong water force is spouted from a first water-spouting port, it is possible to cause a washing water to flow downward to an area under a second water-spouting port. Thereby, it is possible to reduce or prevent occurrence of leaving a part of a waste-receiving surface unwashed in an area under a second water-spouting port, so that it is possible to improve a washing performance for the waste-receiving surface.

Furthermore, the flush toilet as described above further includes a connection part that has a concave surface that connects the waste-receiving surface and the rim part and is curved so as to have a curvature that decreases from an upstream side to a downstream side of the first flow just before the second water-spouting port in a flow direction of the first flow.

In such a configuration, a curvature of a concave surface of a connection part that connects a waste-receiving surface and a rim part decreases from an upstream side to a downstream side just before a second water-spouting port in a flow direction of a first flow, so that it is possible for a shape of such a connection part to increase a vector with a downward direction for a washing water that swirls on the waste-receiving surface by centrifugal force. Hence, for example, even in a flush toilet where a washing water with strong water force is spouted from a first water-spouting port, it is possible to cause a washing water to flow downward to an area under a second water-spouting port. Thereby, it is possible to reduce or prevent occurrence of leaving a part of a waste-receiving surface unwashed in an area under a second water-spouting port, so that it is possible to improve a washing performance for the waste-receiving surface.

In a flush toilet according to an aspect of an embodiment, it is possible to improve a washing performance for a waste-receiving surface.

Appendix (1-1)

A flush toilet, characterized by including:

a bowl part that has a waste-receiving surface with a bowl shape that receives waste and a rim part that extends upward on an upper edge part of the waste-receiving surface;

a trap pipe line that is communicated with a bottom part of the bowl part and extends from the bottom part, and discharges waste that is received by the waste-receiving surface;

a first water-spouting port that spouts a washing water toward the rim part so as to form a first flow of a washing water that swirls on the waste-receiving surface;

a second water-spouting port that spouts a washing water toward the rim part so as to form a second flow of a washing water that joins the first flow; and a connection part that has a concave surface that connects the waste-receiving surface and the rim part and is curved so as to have a curvature that decreases from an upstream side to a downstream side of the first flow just before the first water-spouting port or the second water-spouting port in a flow direction of the first flow.

Appendix (1-2)

The flush toilet according to Appendix (1-1), characterized in that the connection part is provided in such a manner that an occupancy of the connection part in upward and downward directions increases from an upstream side to a downstream side of the first flow.

Appendix (1-3)

The flush toilet according to Appendix (1-1) or Appendix (1-2), characterized in that:

the second water-spouting port is arranged on a back part of the bowl part; and the connection part has a concave surface that is curved so as to have a curvature that decreases from an upstream side to a downstream side of the first flow just before the second water-spouting port in a flow direction of the first flow.

Appendix (1-4)

The flush toilet according to Appendix (1-3), characterized in that the connection part is provided in such a manner that a starting point in the flow direction where a curvature of the concave surface decreases is positioned at a back side of a center of the bowl part in frontward and backward directions.

Appendix (1-5)

The flush toilet according to Appendix (1-4), characterized in that the connection part occupies half or more of a distance from a lowermost end of the connection part to an uppermost end of the rim part on a downstream side of the starting point.

Appendix (2-1)

A flush toilet, characterized by including:

a bowl part that has a waste-receiving surface with a bowl shape that receives waste and a rim part that extends upward on an upper edge part of the waste-receiving surface;

a trap pipe line that is communicated with a bottom part of the bowl part and extends from the bottom part, and discharges waste that is received by the waste-receiving surface;

a first water-spouting port that spouts a washing water toward the rim part so as to form a first flow of a washing water that swirls on the waste-receiving surface;

a first rim water conduit that is positioned at an upstream side of the first water-spouting port where a washing water that is supplied to the first water-spouting port flows;

a second water-spouting port that spouts a washing water toward the rim part so as to form a second flow of a washing water that joins the first flow; and a second rim water conduit that is positioned at an upstream side of the second water-spouting port where a washing water that is supplied to the second water-spouting port flows, wherein the second rim water conduit has a bending part that changes a flow direction of a washing water that is supplied to the second water-spouting port to an opposite direction thereof and a sloping part where a bottom surface of the second rim water conduit slopes downward toward a downstream side, on a downstream side of the bending part.

Appendix (2-2)

The flush toilet according to Appendix (2-1), characterized in that the sloping part is arranged just after the bending part on a downstream side thereof.

Appendix (2-3)

The flush toilet according to Appendix (2-2), characterized in that the second rim water conduit further has a flat part where a slope angle thereof is closer to a horizontal one than that of the sloping part, on a downstream side of the sloping part.

Appendix (2-4)

The flush toilet according to Appendix (2-3), characterized in that the second rim water conduit is provided in such a manner that a top surface of the bending part on a downstream side thereof, in a top surface of the second rim water conduit, is lower than a top surface of the bending part on an upstream side thereof.

Appendix (2-5)

The flush toilet according to any one of Appendix (2-1) to Appendix (2-4), characterized by further including a connection part that has a concave surface that connects the waste-receiving surface and the rim part and is curved so as to have a curvature that decreases from an upstream side to a downstream side of the first flow just before the second water-spouting port in a flow direction of the first flow.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet, comprising:

a bowl part that includes a waste-receiving surface with a bowl shape that receives waste and a rim part that extends upward on an upper edge part of the waste-receiving surface;

a trap pipe line that is communicated with a bottom part of the bowl part and extends from the bottom part, and discharges waste that is received by the waste-receiving surface;

a first water-spouting port that spouts a washing water toward the rim part to form a first flow of a washing water that swirls on the waste-receiving surface;

a second water-spouting port that spouts a washing water toward the rim part to form a second flow of a washing water that joins the first flow; and a connection part that connects the waste-receiving surface and the rim part and includes a concave surface that is curved to have a curvature that gradually decreases from an upstream side to a downstream side of the first flow just before the first water-spouting port or the second water-spouting port in a flow direction of the first flow.

2. The flush toilet according to claim 1, wherein the connection part is provided in such a manner that an occupancy of the connection part in upward and downward directions increases from an upstream side to a downstream side of the first flow.

3. The flush toilet according to claim 1, wherein:

the second water-spouting port is arranged on a back part of the bowl part; and the connection part includes a concave surface that is curved to have a curvature that gradually decreases from an upstream side to a downstream side of the first flow just before the second water-spouting port in a flow direction of the first flow.

4. The flush toilet according to claim 3, wherein the connection part is provided in such a manner that a starting point in the flow direction where a curvature of the concave surface gradually decreases is positioned at a back side of a center of the bowl part in frontward and backward directions.

5. The flush toilet according to claim 4, wherein the connection part occupies half or more of a distance from a lowermost end of the connection part to an uppermost end of the rim part on a downstream side of the starting point.

6. The flush toilet according to claim 3, further comprising:

a first rim water conduit that is positioned at an upstream side of the first water-spouting port where a washing water that is supplied to the first water-spouting port flows; and a second rim water conduit that is positioned at an upstream side of the second water-spouting port where a washing water that is supplied to the second water-spouting port flows, wherein the second rim water conduit includes a bending part that changes a flow direction of a washing water that is supplied to the second water-spouting port to an opposite direction thereof and a sloping part where a bottom surface of the second rim water conduit slopes downward toward a downstream side, on a downstream side of the bending part.

7. The flush toilet according to claim 6, wherein the sloping part is arranged just after the bending part on a downstream side thereof.

8. The flush toilet according to claim 7, wherein the second rim water conduit further includes a flat part where a slope angle thereof is closer to a horizontal one than that of the sloping part, on a downstream side of the sloping part.

9. The flush toilet according to claim 8, wherein the second rim water conduit is provided in such a manner that a top surface of the bending part on a downstream side thereof, in a top surface of the second rim water conduit, is lower than a top surface of the bending part on an upstream side thereof.

* * * * *